US010880643B2

(12) United States Patent
Shioda et al.

(10) Patent No.: US 10,880,643 B2
(45) Date of Patent: Dec. 29, 2020

(54) SOUND-SOURCE-DIRECTION DETERMINING APPARATUS, SOUND-SOURCE-DIRECTION DETERMINING METHOD, AND STORAGE MEDIUM

(71) Applicant: FUJITSU LIMITED, Kawasaki (JP)

(72) Inventors: Chisato Shioda, Sagamihara (JP); Nobuyuki Washio, Akashi (JP); Masanao Suzuki, Yokohama (JP)

(73) Assignee: FUJITSU LIMITED, Kawasaki (JP)

( * ) Notice: Subject to any disclaimer, the term of this patent is extended or adjusted under 35 U.S.C. 154(b) by 0 days.

(21) Appl. No.: 16/558,360

(22) Filed: Sep. 3, 2019

(65) Prior Publication Data

US 2020/0107119 A1 Apr. 2, 2020

(30) Foreign Application Priority Data

Sep. 27, 2018 (JP) ..... 2018-181307

(51) Int. Cl.
*H04R 3/00* (2006.01)
*H04R 29/00* (2006.01)
*H04R 1/40* (2006.01)

(52) U.S. Cl.
CPC ..... *H04R 3/005* (2013.01); *H04R 1/406* (2013.01); *H04R 29/001* (2013.01)

(58) Field of Classification Search
CPC ..... H04R 3/005; H04R 1/245; H04R 1/265; H04R 1/326; H04R 1/406; H04R 29/001; H04R 29/005; H04R 2499/11
(Continued)

(56) References Cited

U.S. PATENT DOCUMENTS

2009/0018828 A1 1/2009 Nakadai et al.
2013/0080168 A1* 3/2013 Iida ..... H04R 3/005 704/246

(Continued)

FOREIGN PATENT DOCUMENTS

| | | |
|---|---|---|
| JP | 2002-135642 | 5/2002 |
| JP | 2018-40982 | 3/2018 |
| WO | 2005/048239 | 5/2005 |

OTHER PUBLICATIONS

N. Watanabe et al., "Basic study on estimating the sound source position using directional microphone", online, searched on Sep. 13, 2018, internet URL<:http://www.cit.nihon-u.ac.jp/kouendata/No.41/2_denki/2-008.pdf> with partial English Translation (14 pages).

(Continued)

*Primary Examiner* — Jason R Kurr
(74) *Attorney, Agent, or Firm* — Fujitsu Patent Center

(57) ABSTRACT

A sound-source-direction determining apparatus includes a processor that updates a reference threshold such that the reference threshold increases as a sound pressure difference increases, the sound pressure difference being a difference between sound pressure of a certain frequency component of sound acquired by the first microphone and sound pressure of the certain frequency component of the sound acquired by the second microphone when the synthesized sound is output from the speaker and determines a direction in which a sound source of sound is located, based on comparison between the reference threshold and a sound pressure difference between sound pressure of a certain frequency component of the sound acquired by the first microphone and sound pressure of the certain frequency component of the sound acquired by the second microphone when the synthesized sound is not output from the speaker.

17 Claims, 30 Drawing Sheets

(58) Field of Classification Search
USPC ..... 381/92
See application file for complete search history.

(56) References Cited

U.S. PATENT DOCUMENTS

| | | | | |
|---|---|---|---|---|
| 2013/0251183 | A1* | 9/2013 | Doller | H04R 1/086 381/368 |
| 2015/0245152 | A1* | 8/2015 | Ding | H04R 1/406 381/56 |
| 2018/0068677 | A1 | 3/2018 | Suzuki et al. | |
| 2019/0043467 | A1* | 2/2019 | Zhou | H04R 3/00 |
| 2019/0095430 | A1* | 3/2019 | Smus | G06F 40/58 |

OTHER PUBLICATIONS

K. Yamamoto, "Calculation Methods for Noise Screen Effect", The journal of the INCE of Japan, vol. 21, No. 3, pp. 143-147, 1997, with partial English Translation (17 pages).

* cited by examiner

FIG. 5

| AREA [SQUARE cm] | SOUND PRESSURE [dBov] | | SOUND PRESSURE DIFFERENCE [dB] |
|---|---|---|---|
| | FRONT | ABOVE | |
| 2 | -26 | -29 | 3 |
| 63 | -24 | -30 | 6 |

FIG. 14

| | WITHOUT GAP | | WITH GAP | |
|---|---|---|---|---|
| | ABOVE NU | FRONT NF | ABOVE GU | FRONT GF |
| TH_C1 | ABOVE | FRONT | FRONT | FRONT |
| TH_C2 | ABOVE | ABOVE | ABOVE | FRONT |
| TH_CP | ABOVE | FRONT | ABOVE | FRONT |

FIG. 23

| TYPE OF MICROPHONE | SIZE |
|---|---|
| DIRECTIONAL MICROPHONE | HIGHT 4.5m<br>DIAMETER 8mm<br>VOLUME 226CUBEmm |
| OMNIDIRECTIONAL MICROPHONE | HIGHT 1.1m<br>WIDTH 3.6mm<br>DEPTH 2.8mm<br>VOLUME 11CUBEmm |

FIG. 25

| POSITION OF SOUND SOURCE | SOUND PRESSURE DIFFERENCE | | |
|---|---|---|---|
| | RELATED ART | FIRST EMBODIMENT | DIFFERENCE |
| ABOVE | 2.9 | 7.2 | 4.3 |
| FRONT | -2.9 | -4.2 | 1.3 |

SOUND-SOURCE-DIRECTION DETERMINING APPARATUS, SOUND-SOURCE-DIRECTION DETERMINING METHOD, AND STORAGE MEDIUM

CROSS-REFERENCE TO RELATED APPLICATION

This application is based upon and claims the benefit of priority of the prior Japanese Patent Application No. 2018-181307, filed on Sep. 27, 2018, the entire contents of which are incorporated herein by reference.

FIELD

The embodiments discussed herein are related to a sound-source-direction determining apparatus, a sound-source-direction determining method, and a storage medium.

BACKGROUND

There are sound-source-direction determining apparatuses that determine the direction in which a sound source is located. In each of such sound-source-direction determining apparatuses, a first directional microphone is arranged to detect sound propagating in a first direction and a second directional microphone is arranged to detect sound propagating in a second direction that intersects with the first direction. If sound pressure of sound detected by the first directional microphone is greater than sound pressure of the sound detected by the second directional microphone, the sound-source-direction determining apparatus determines that the sound is sound that has propagated in the first direction. On the other hand, if sound pressure of sound detected by the second directional microphone is greater than sound pressure of the sound detected by the first directional microphone, the sound-source-direction determining apparatus determines that the sound is sound that has propagated in the second direction.

Examples of the related art documents include, for example, Japanese Laid-open Patent Publication No. 2018-40982; Watanabe et al., "Basic study on estimating the sound source position using directional microphone", [online], [retrieved on Sep. 13, 2018], Internet (URL: http://www.cit.nihon-u.ac.jp/kouendata/No. 41/2_denki/2-008.pdf); and Yamamoto Kohei, "Calculation Methods for Noise Screen Effect", The journal of the INCE of Japan, Japan, Vol. 21, No. 3, pp. 143 to 147, 1997.

Directional microphones are larger in size and more costly than omnidirectional microphones. Thus, sound-source-direction determining apparatuses using directional microphones are undesirably larger in size and more costly than those using omnidirectional microphones.

SUMMARY

According to an aspect of the embodiments, a sound-source-direction determining apparatus, includes a microphone disposed portion having therein a first sound path having a first end and a second end and a second sound path having a first end and a second end, the first sound path having, at the first end thereof, a first opening that is open at a first flat surface, sound propagating through the first sound path from the first opening, the second sound path having, at the first end thereof, a second opening that is open at a second flat surface intersecting with the first flat surface, sound propagating through the second sound path from the second opening, a first microphone that is omnidirectional and is disposed at or in the vicinity of the second end of the first sound path, a second microphone that is omnidirectional and is disposed at or in the vicinity of the second end of the second sound path, a speaker that outputs synthesized sound, and a processor, wherein the processor updates a reference threshold such that the reference threshold increases as a sound pressure difference increases, the sound pressure difference being a difference between sound pressure of a certain frequency component of sound acquired by the first microphone and sound pressure of the certain frequency component of the sound acquired by the second microphone when the synthesized sound is output from the speaker, and determines a direction in which a sound source of sound is located, based on comparison between the reference threshold and a sound pressure difference between sound pressure of a certain frequency component of the sound acquired by the first microphone and sound pressure of the certain frequency component of the sound acquired by the second microphone when the synthesized sound is not output from the speaker.

The object and advantages of the invention will be realized and attained by means of the elements and combinations particularly pointed out in the claims.

It is to be understood that both the foregoing general description and the following detailed description are exemplary and explanatory and are not restrictive of the invention.

BRIEF DESCRIPTION OF DRAWINGS

FIG. 5 is a table illustrating sound pressure differences between sound pressure obtained by a first microphone and sound pressure obtained by a second microphone when a flat surface has different areas;

FIG. 14 is a schematic diagram for describing updating of the reference threshold;

FIG. 23 is an exemplary table comparing the size of a directional microphone with the size of an omnidirectional microphone;

FIG. 25 is a table illustrating an example of comparison between a sound pressure difference in the related art and a sound pressure difference in the first embodiment.

DESCRIPTION OF EMBODIMENTS

It is desirable to increase the accuracy of determining the direction of the sound source by using omnidirectional microphones, regardless of the size of a gap between a housing of an information processing terminal and a wearer of the information processing terminal.

First Embodiment

Hereinafter, an example of a first embodiment will be described in detail with reference to the accompanying drawings.

Figure 1:
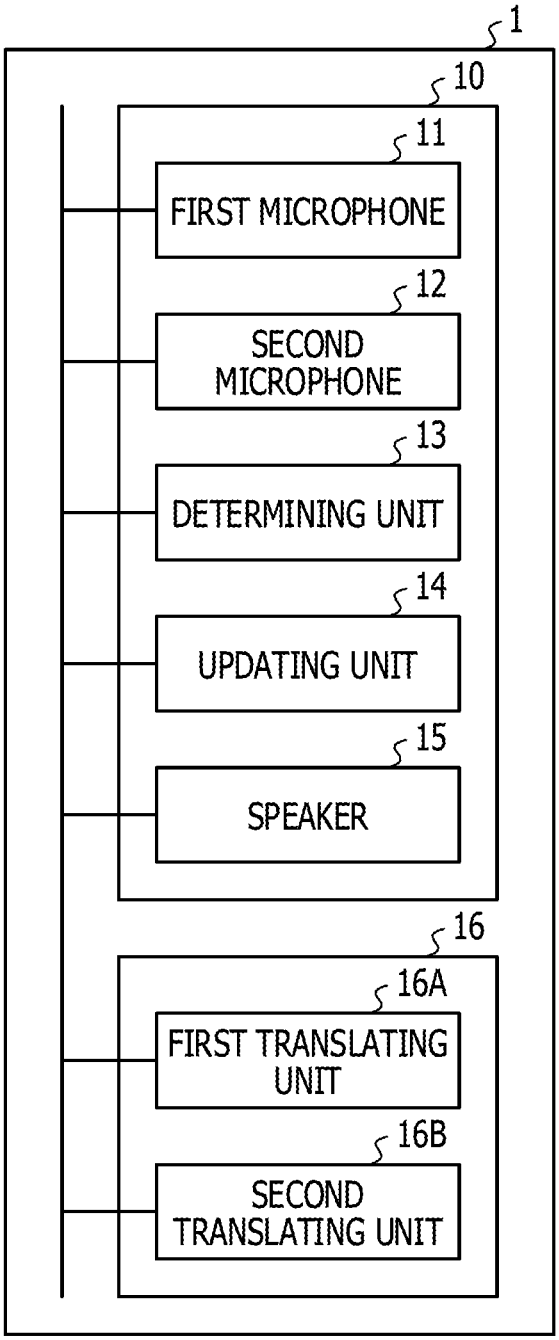
FIG. 1 is a block diagram illustrating an example of an information processing terminal according to first to third embodiments.

FIG. 1 illustrates an example of functions of principal components of an information processing terminal 1. The information processing terminal 1 includes a sound-source-direction determining apparatus 10 and a speech translating apparatus 16.

The sound-source-direction determining apparatus 10 includes a first microphone 11, a second microphone 12, a determining unit 13, an updating unit 14, and a speaker 15. The speech translating apparatus 16 includes a first translating unit 16A and a second translating unit 16B.

Each of the first microphone 11 and the second microphone 12 is an omnidirectional microphone, and acquires sound propagating from all directions. The determining unit 13 determines a direction in which a sound source of sound acquired by the first microphone 11 and the second microphone 12 is located (hereinafter referred to as the direction of the sound source).

The updating unit 14 updates a reference threshold used when the determining unit 13 determines the direction of the sound source. Based on the direction of the sound source determined by the determining unit 13, the speech translating apparatus 16 translates a language represented by a sound signal corresponding to the sound that propagates from the direction of the sound source and is acquired by the first microphone 11 or the second microphone 12 into a certain language.

Specifically, for example, when the determining unit 13 determines that the sound source is located in a first direction which is the upward direction, the first translating unit 16A translates a language represented by a sound signal corresponding to the acquired sound into a first language (for example, English). For example, when the determining unit 13 determines that the sound source is located in a second direction which is the forward direction, the second translating unit 16B translates a language represented by a sound signal corresponding to the acquired sound into a second language (for example, Japanese). The speaker 15 outputs the language obtained as a result of the first translating unit 16A or the second translating unit 16B translating the original language, voice guidance, and the like, by using synthesized sound.

Figure 2A:
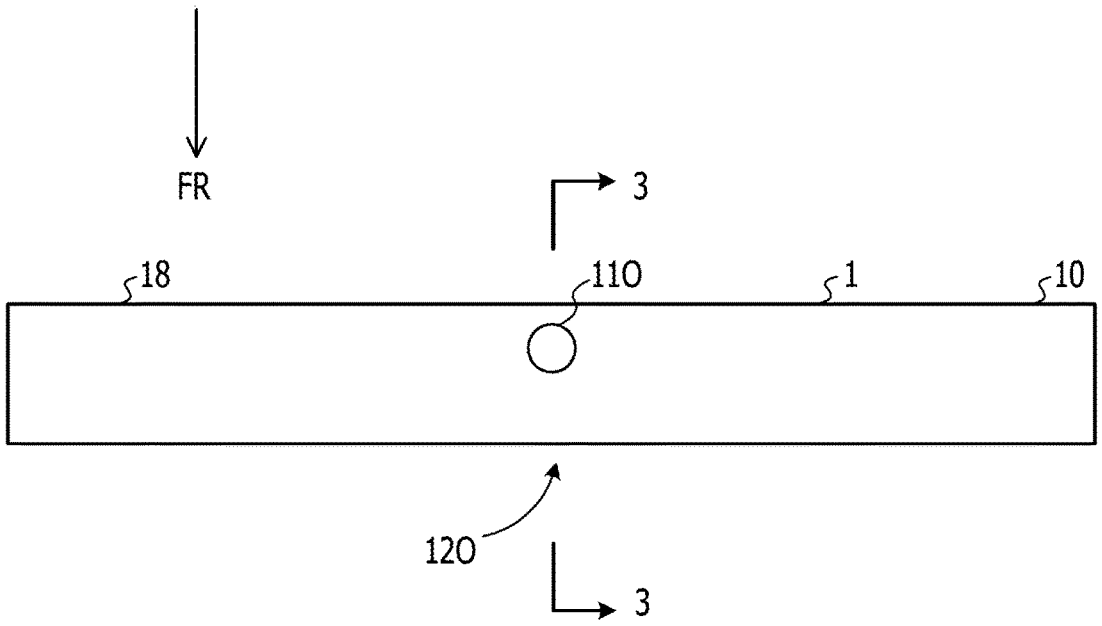
FIG. 2A is a schematic diagram illustrating an example of the appearance of the information processing terminal according to the first to third embodiments.
Figure 2B:
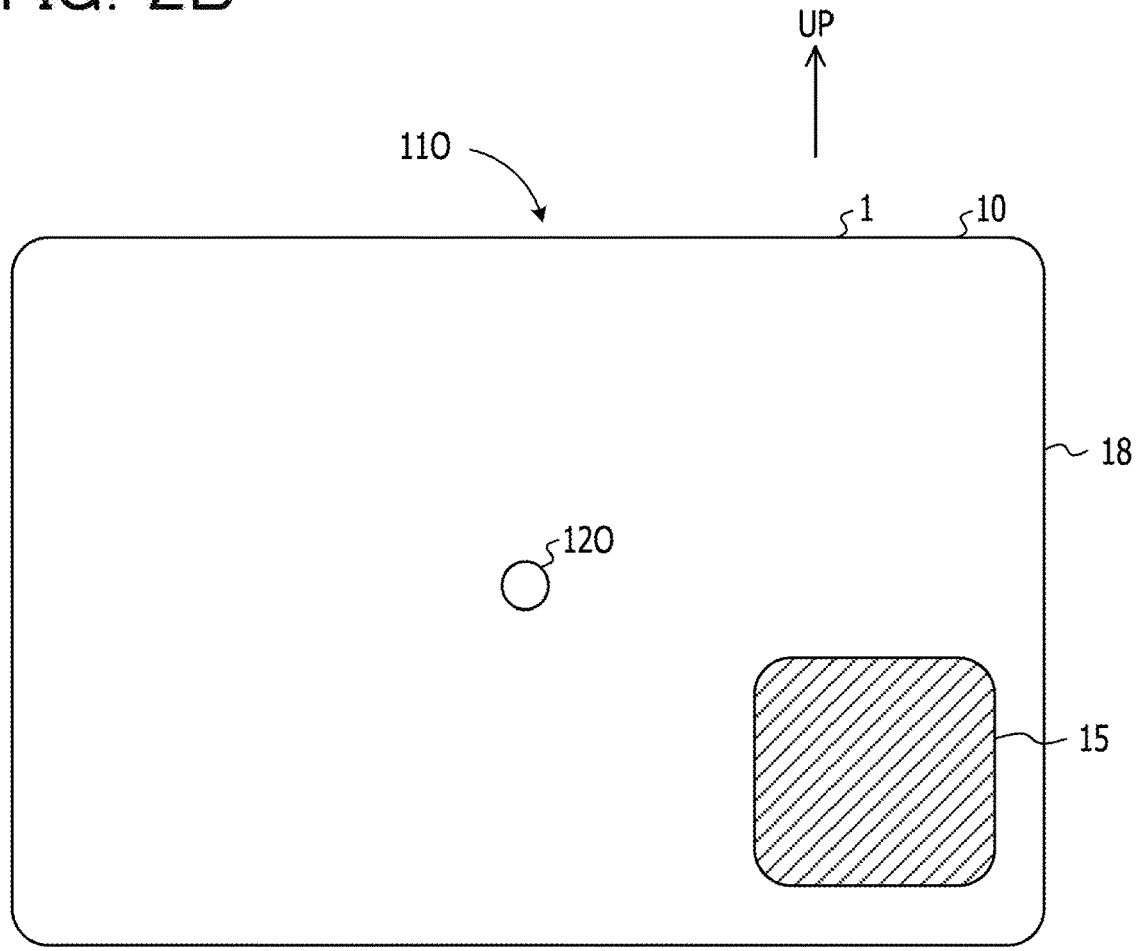
FIG. 2B is a schematic diagram illustrating an example of the appearance of the information processing terminal according to the first to third embodiments.

FIGS. 2A and 2B illustrate an example of the appearance of the information processing terminal 1 including the sound-source-direction determining apparatus 10 and the speech translating apparatus 16. For example, the information processing terminal 1 is expectedly used in the following way. A user hangs the information processing terminal 1 from the upper edge of the chest pocket of the user's shirt by using a clip that is attached to a central portion of the upper edge of the information processing terminal 1. Alternatively, a user hangs the information processing terminal 1 from the neck by using a strap that is attached to the central portion of the upper edge of the information processing terminal 1. FIG. 2A illustrates an example of an upper surface of a housing 18 of the information processing terminal 1. The housing 18 is an example of a microphone disposed portion. The upper surface of the housing 18, which is an example of a first flat surface, is a surface that faces upward, that is, a surface that is the closest to the user's mouth when the information processing terminal 1 is clipped to the upper edge of the chest pocket.

An opening 11O provided at one end of a first sound path is present at the upper surface of the housing 18. The opening 11O is an example of a first opening. The first microphone 11 is disposed at the other end of the first sound path. An arrow FR in FIG. 2A indicates a front direction of the information processing terminal 1 below. The upper surface of the housing 18 has, for example, a length of 1 [cm] in the front-rear direction.

FIG. 2B illustrates a front surface of the housing 18 of the information processing terminal 1. The front surface, which is an example of a second flat surface, is a surface facing an interaction partner whom the user interacts with when the information processing terminal 1 is clipped to the upper edge of the chest pocket.

An opening 12O provided at one end of a second sound path is present at the front surface of the housing 18. The second microphone 12 is disposed at the other end of the second sound path. An arrow UP in FIG. 2B represents an upward direction of the information processing terminal 1 below. The speaker 15 is also disposed at the front surface of the housing 18. The size of the front surface of the housing 18 is, for example, approximately the same as the size of an ordinary business card.

The sound-source-direction determining apparatus 10 determines that sound whose sound source is determined to be located in the upward direction is voice uttered by the user. The sound-source-direction determining apparatus 10 then sends a sound signal corresponding to the sound to the first translating unit 16A of the speech translating apparatus 16 so that the sound is translated into the first language and the resulting voice is output from the speaker 15. The sound-source-direction determining apparatus 10 determines that sound whose sound source is determined to be located in the forward direction is voice uttered by the interaction partner. The sound-source-direction determining apparatus 10 sends a sound signal corresponding to the sound to the second translating unit 16B of the speech translating apparatus 16 so that the sound is translated into the second language and the resulting voice is output from the speaker 15.

Figure 3:
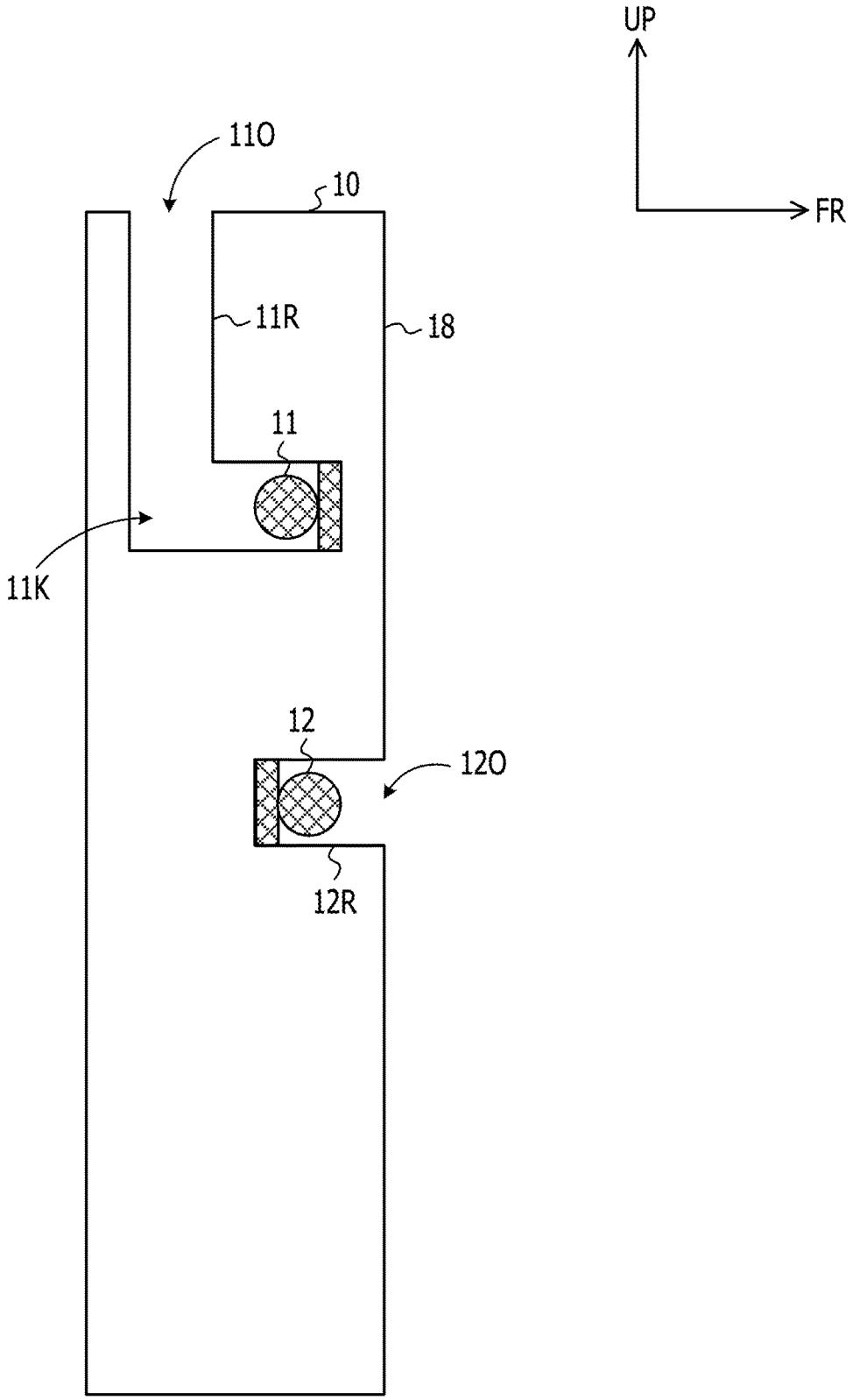
FIG. 3 is a sectional view taken along the line III-III in FIG. 2A in accordance with the first and second embodiments.

FIG. 3 is a sectional view taken along the line III-III in FIG. 2A. The opening 12O that is open at the front surface of the housing 18 is present at one end of a second sound path 12R. The second microphone 12 is disposed at the other end of the second sound path 12R. FIG. 3 illustrates an example in which the second microphone 12 is disposed at the other end of the second sound path 12R. However, the first embodiment is not limited to this configuration. The second microphone 12 may be disposed on a side wall that constitutes the second sound path 12R, in the vicinity of the other end of the second sound path 12R. In this case, the distance between the second microphone 12 and the other end may be equal to or less than a certain length. The certain length may be, for example, 0.5 [mm].

The opening 11O that is open at the upper surface of the housing 18 is present at one end of a first sound path 11R. The first microphone 11 is disposed at the other end of the first sound path 11R. FIG. 3 illustrates an example in which the first microphone 11 is disposed at the other end of the first sound path 11R. However, the first embodiment is not limited to this configuration. The first microphone 11 may be disposed on a side wall that constitutes the first sound path 11R, in the vicinity of the other end of the first sound path 11R. In this case, the distance between the first microphone 11 and the other end may be equal to or less than a certain length. The certain length may be, for example, 0.5 mm. The first sound path 11R has a bend 11K midway thereof. The bend 11K is an example of a second diffraction portion.

Figure 4A:
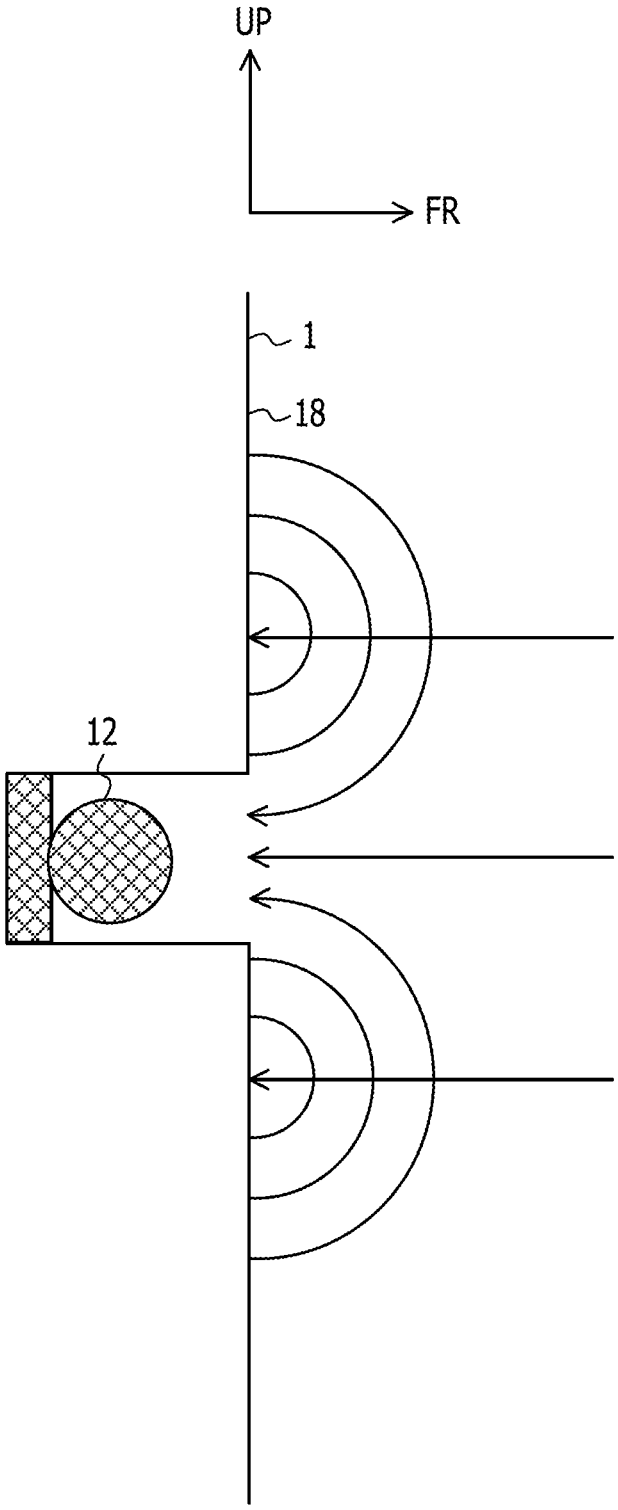
FIG. 4A is a schematic diagram for describing diffraction of sound in the first and second embodiments.

FIG. 4A illustrates a case where a sound source is located in front of the information processing terminal 1. When the area of the front surface of the housing 18 is greater than a certain value, the second microphone 12 acquires sound directly reaching the second microphone 12 through the opening 12O and sound that is reflected at the front surface of the housing 18 and is then diffracted at the opening 12O, which is an example of a third diffraction portion.

Figure 4B:
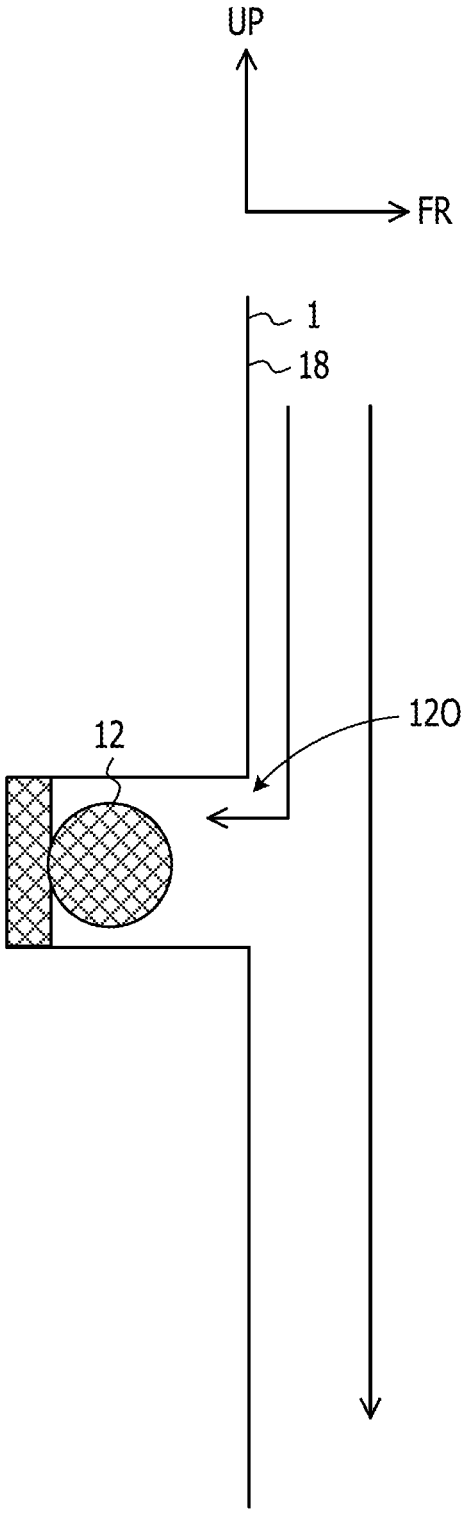
FIG. 4B is a schematic diagram for describing diffraction of sound in the first and second embodiments.

FIG. 4B illustrates a case where a sound source is located above the information processing terminal 1. Sound does not directly reach the second microphone 12. Thus, the second microphone 12 acquires sound diffracted at the opening 12O. Therefore, sound pressure of sound acquired by the second microphone 12 is greater in the case where the sound source is located in front of the information processing terminal 1 than in the case where the sound source is located above the information processing terminal 1.

FIG. 5 illustrates sound pressures of sound acquired by the second microphone 12 in the case where the sound source is located in front of the information processing terminal 1 and in the case where the sound source is located above the information processing terminal 1. In the case where the area of the front surface of the information processing terminal 1 is equal to 2 [square cm], which is an example of a size equal to or smaller than a certain value, the sound pressure of the sound whose sound source is located in front of the information processing terminal 1 is equal to −26 [dBov]. In addition, the sound pressure of sound whose sound source is located above the information processing terminal 1 is equal to −29 [dBov]. Thus, the sound pressure difference between the sound pressure of the sound from the sound source located in front of the information processing terminal 1 and the sound pressure of the sound from the sound source located above the information processing terminal 1 is equal to 3 [dB].

On the other hand, in the case where the area of the front surface of the information processing terminal 1 is equal to 63 [square cm], which is an example of a size larger than the certain value, sound pressure of sound whose sound source is located in front of the information processing terminal 1 is equal to −24 [dBov]. Sound pressure of sound whose sound source is located above the information processing terminal 1 is equal to −30 [dBov]. Thus, the sound pressure difference between the sound pressure of the sound from the sound source located in front of the information processing terminal 1 and the sound pressure of the sound from the sound source located above the information processing terminal 1 is equal to 6 [dB].

That is, the sound pressure difference is larger and thus it is easier to determine the direction of the sound source in the case where the area of the front surface of the information processing terminal 1 is equal to 63 [square cm] than in the case where the area of the front surface of the information processing terminal 1 is equal to 2 [square cm]. This is because sound whose sound source is located in front of the information processing terminal 1 is sufficiently reflected if the area of the front surface is larger than the certain value.

The certain value may be, for example, 1000 times the cross-sectional area of the sound path. Specifically, in the case where the diameter of the microphone hole of the second microphone 12 is equal to 0.5 [mm], for example, and the second sound path 12R has a circular cross section whose diameter is 1 [mm], which is twice the diameter of the microphone hole of the second microphone 12, the area may be larger than approximately 785 [square mm]. For example, the second sound path 12R may have a uniform diameter from the one end to the other end. Alternatively, the diameter of the second sound path 12R may gradually decrease from the one end toward the other end. The second sound path 12R may also have a quadrangular cross section, for example.

The length from the one end to the other end of the second sound path 12R may be equal to, for example, 3 [mm]. However, the length may be longer than or shorter than 3 [mm]. The second sound path 12R may be orthogonal to the front surface of the housing 18. Alternatively, the second sound path 12R and the front surface of the housing 18 may intersect at an angle other than 90 [degrees].

Figure 6A:
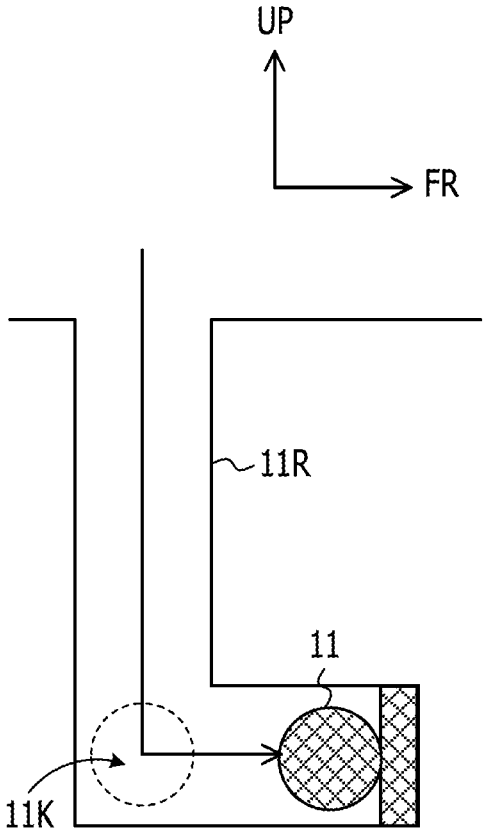
FIG. 6A is a schematic diagram for describing diffraction of sound in the first to third embodiments.

Sound pressures obtained by the first microphone 11 in the case where the sound source is located above the information processing terminal 1 and in the case where the sound source is located in front of the information processing terminal 1 will be described with reference to FIGS. 6A and 6B. FIG. 6A illustrates a case where the sound source is located above the information processing terminal 1.

The length of the upper surface of the housing 18 in the front-rear direction is short and the area of the upper surface is less than or equal to the certain value. Thus, in the case where the sound source is located above the information processing terminal 1, acquisition of reflected sound and diffracted sound of sound illustrated in FIG. 4A is not expected. Therefore, the first sound path 11R has the bend 11K. Since the first sound path 11R has the bend 11K, sound from the above does not directly reach the first microphone 11. Instead, the sound diffracts at the bend 11K of the first sound path 11R and is acquired by the first microphone 11.

Figure 6B:
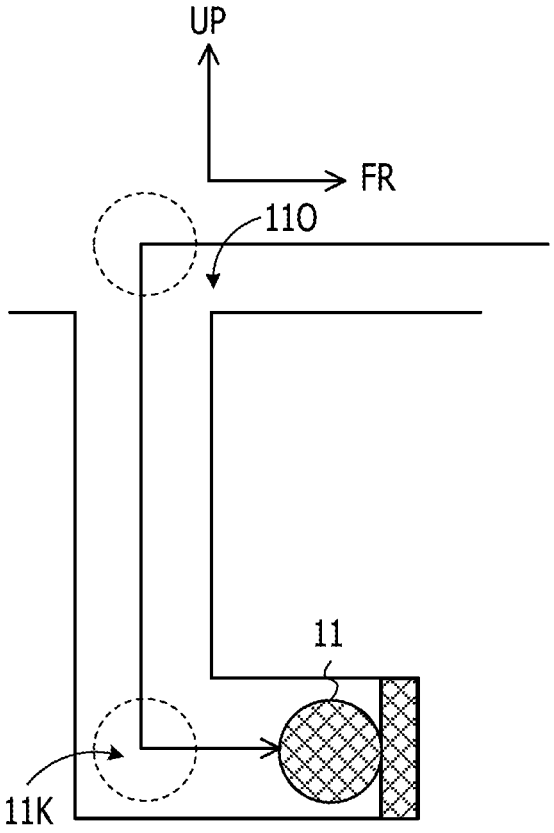
FIG. 6B is a schematic diagram for describing diffraction of sound in the first to third embodiments.

FIG. 6B illustrates a case where the sound source is located in front of the information processing terminal 1. Sound diffracts at the opening 11O, which is an example of a first diffraction portion, further diffracts at the bend 11K, and is then acquired by the first microphone 11.

Figure 7:
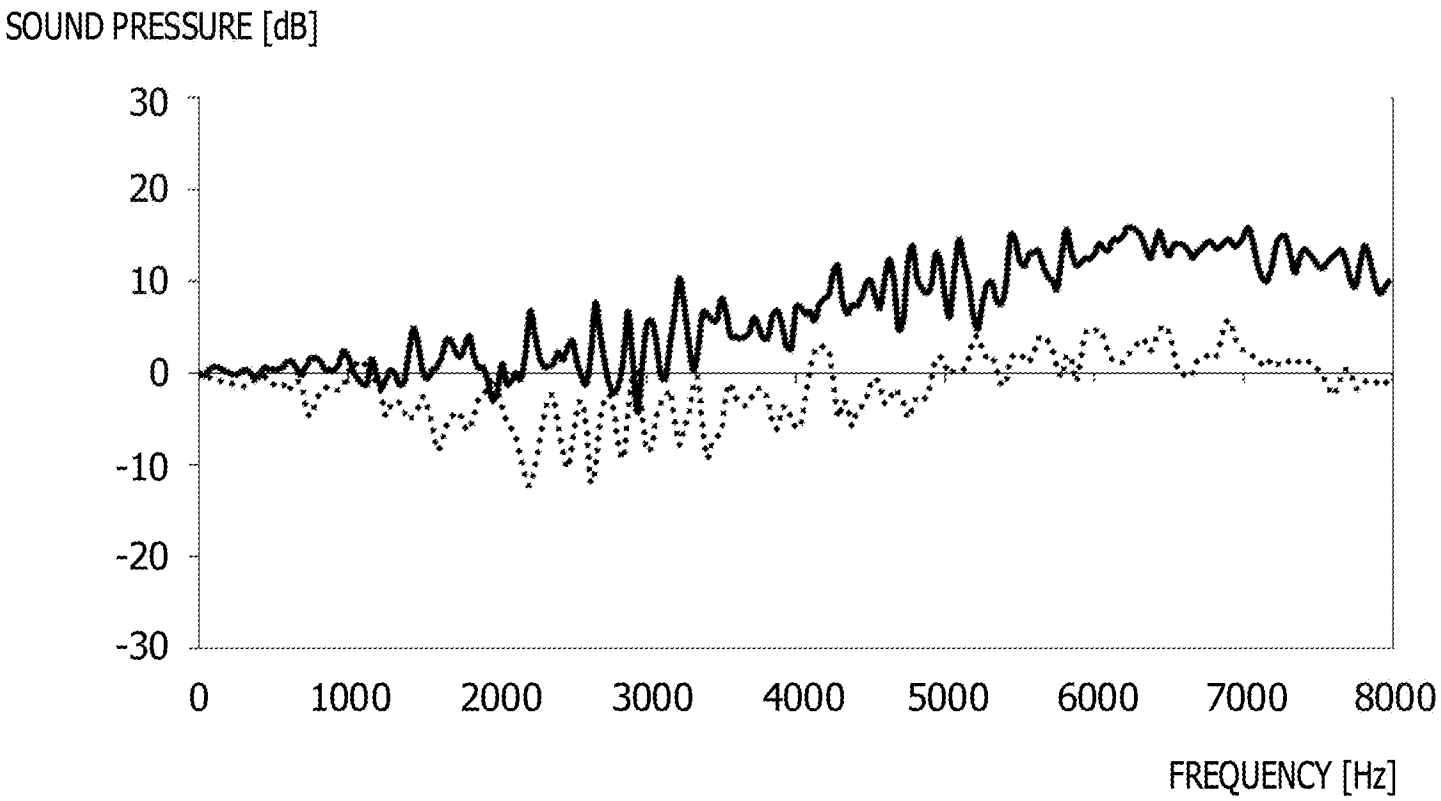
FIG. 7 is a graph for describing a diffraction-induced drop in sound pressure along a frequency axis.

FIG. 7 illustrates a sound pressure difference between sound pressure of sound acquired by the first microphone 11 in the case where the sound source is located above the information processing terminal 1 and sound pressure of sound acquired by the first microphone 11 in the case where the sound source is located in front of the information processing terminal 1. A solid line represents sound pressure [dB] of sound acquired by the first microphone 11 in the case where the sound source is located above the information processing terminal 1. A broken line represents sound pressure [dB] of sound acquired by the first microphone 11 in the case where the sound source is located in front of the information processing terminal 1.

Specifically, a distance between the solid line and the broken line in the vertical direction represents the sound pressure difference between the sound pressure of the sound acquired by the first microphone 11 in the case where the sound source is located above the information processing terminal 1 and the sound pressure of the sound acquired by the first microphone 11 in the case where the sound source is located in front of the information processing terminal 1. The horizontal axis of the graph in FIG. 7 denotes a frequency [Hz]. The sound pressure difference tends to be smaller at lower frequencies and larger at higher frequencies. That is, the sound pressure difference between the case where the sound source is located above the information processing terminal 1, in which diffraction occurs once, and the case where the sound source is located in front of the information processing terminal 1, in which diffraction occurs twice, is more remarkable at higher frequencies.

A sound attenuation amount R [dB] due to diffraction is expressed by Equation (1), for example.

$$R=\begin{cases}10\log_{10}N+13 & \text{for } N\geq 1.0\\ 5\pm[8/\sinh^{-1}(1)]\cdot\sinh^{-1}(|N|^{0.485}) & \text{for } -0.324\leq N<1.0\\ 0 & \text{for } N<-0.324\end{cases} \quad (1)$$

In Equation (1), N is a Fresnel number and is denoted by Equation (2).

$$N=\delta/(A/2)=\delta\cdot f/165 \quad (2)$$

In Equation (2), 6 denotes a path difference [m] between a diffraction path and a direct path, A denotes a wavelength [m] of the sound, and f denotes a frequency [Hz] of the sound. Equation (2) assumes the case where the sound velocity (=λ×f) is equal to 330 [m/s]. That is, as illustrated in the graph of FIG. 7, the sound attenuation amount R due to diffraction tends to be larger at higher frequencies f. Thus, in the first embodiment, a sound pressure difference at a high-frequency component of sound is used when the direction of the sound source is determined.

In the case where the diameter of the microphone hole of the first microphone 11 is equal to 0.5 [mm], the first sound path 11R may have a circular cross section having a diameter of 1 mm, which is twice the diameter of the microphone hole. For example, the first sound path 11R may have a uniform diameter from the one end to the other end. Alternatively, the diameter of the first sound path 11R may gradually decrease from the one end toward the other end.

The first sound path 11R may have a diameter that gradually decreases from the one end toward the bend 11K and that is uniform from the bend 11K to the other end. Further, the first sound path 11R may have a quadrangular cross section, for example.

The length from the one end to the bend 11K of the first sound path 11R and the length from the bend 11K to the other end of the first sound path 11R may be equal to, for example, 3 [mm]. Alternatively, the lengths may be longer than or shorter than 3 [mm]. In addition, a portion from the one end to the bend 11K of the first sound path 11R may be orthogonal to the upper surface of the housing 18. Alternatively, the portion of the first sound path 11R may intersect with the upper surface of the housing 18 at an angle other than 90 [degrees]. Further, a portion from the bend 11K to the other end of the first sound path 11R may be orthogonal to the portion from the one end to the bend 11K of the first sound path 11R. Alternatively, the portions may intersect at an angle other than 90 [degrees].

Further, the first microphone 11 is surrounded by a side wall constituting the first sound path 11R and the other end of the first sound path 11R. There is no gap between the other end and the side wall of the first sound path 11R. The first microphone 11 is open in a direction toward the opening 11O. Also, the second microphone 12 is surrounded by a side wall constituting the second sound path 12R and the other end of the second sound path 12R. There is no gap between the other end and the side wall of the second sound path 12R. The second microphone 12 is open in a direction toward the opening 12O. The upper surface and the front surface of the housing 18 are orthogonal to each other. However, the first embodiment is not limited to an example in which the upper surface and the front surface of the housing 18 are orthogonal to each other. The upper surface and the front surface of the housing 18 may intersect at an angle other than 90 [degrees].

Figure 8:
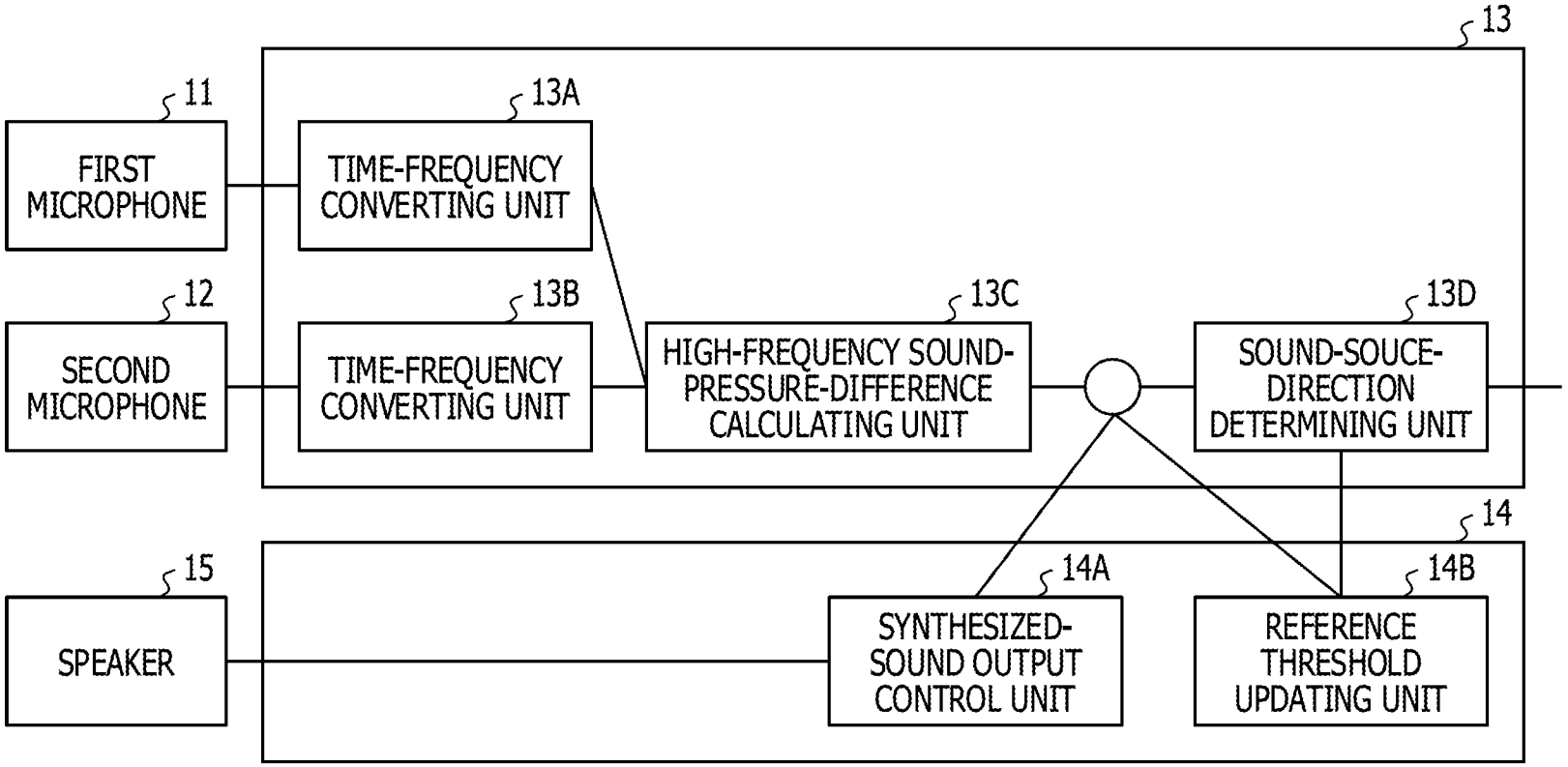
FIG. 8 is a block diagram illustrating an example of a sound-source-direction determining apparatus according to the first to third embodiments.

FIG. 8 illustrates an overview of a sound-source-direction determining process performed by the determining unit 13 according to the first embodiment. A time-frequency converting unit 13A performs time-frequency conversion on a sound signal corresponding to sound acquired by the first microphone 11 disposed as illustrated in FIG. 3. Likewise, a time-frequency converting unit 13B performs time-frequency conversion on a sound signal corresponding to sound acquired by the second microphone 12 disposed as illustrated in FIG. 3. For example, fast Fourier transformation (FFT) is used in the time-frequency conversion.

As described above, the sound pressure difference between the sound pressure of the sound acquired by the first microphone 11 and the sound pressure of the sound acquired by the second microphone 12 appears markedly at high-frequency components. Therefore, a high-frequency sound-pressure-difference calculating unit 13C calculates, as a high-frequency sound pressure difference, an average of sound pressure differences in respective frequency bands at frequencies higher than a certain frequency. A sound-source-direction determining unit 13D determines the position of the sound source based on the high-frequency sound pressure difference calculated by the high-frequency sound-pressure-difference calculating unit 13C.

Specifically, the high-frequency sound-pressure-difference calculating unit 13C calculates spectral power pow1[bin] of the sound signal corresponding to the sound acquired by the first microphone 11, by using Equation (3). The high-frequency sound-pressure-difference calculating unit 13C calculates spectral power pow2[bin] of the sound signal corresponding to the sound acquired by the second microphone 12, by using Equation (4).

$$\text{pow1[bin]}=\text{re1[bin]}^2+\text{im1[bin]}^2 \tag{3}$$

$$\text{pow2[bin]}=\text{re2[bin]}^2+\text{im2[bin]}^2 \tag{4}$$

In Equations (3) and (4), bin=0, . . . , F−1, and F denotes the number of frequency bands and may be equal to 256, for example. In Equation (3), re1[bin] denotes the real part of the frequency spectrum of the frequency band bin, which is obtained when the sound signal of the sound acquired by the first microphone 11 is subjected to the time-frequency conversion. In addition, im1[bin] denotes the imaginary part of the frequency spectrum of the frequency band bin, which is obtained when the sound signal of the sound acquired by the first microphone 11 is subjected to the time-frequency conversion.

In Equation (4), re2[bin] denotes the real part of the frequency spectrum of the frequency band bin, which is obtained when the sound signal of the sound acquired by the second microphone 12 is subjected to the time-frequency conversion. In addition, im2[bin] is the imaginary part of the frequency spectrum of the frequency band bin, which is obtained when the sound signal of the sound acquired by the second microphone 12 is subjected to the time-frequency conversion.

Then, the high-frequency sound-pressure-difference calculating unit 13C calculates a high-frequency sound pressure difference d_pow by using Equation (5).

$$d_\text{pow}=(\Sigma_{i=s}^{F-1}10\ \log_{10}(\text{pow}[i]/\text{pow2}[i]))/((F-1)-s) \tag{5}$$

The high-frequency sound pressure difference d_pow is an example of a difference between a first sound pressure and a second sound pressure. The high-frequency sound pressure difference d_pow is an average of values obtained by subtracting the logarithm of the spectral power pow2[i] from the logarithm of the spectral power pow1[i]. In Equation (5), s denotes the lower limit of the frequency band number of the high-frequency bands and may be equal to 96, for example. In the case where the sampling frequency of the sound signal is equal to 16 [kHz] and s is equal to 96, the high frequency bands indicate 3000 [Hz] to 8 [kHz].

The sound-source-direction determining unit 13D compares the high-frequency sound pressure difference d_pow with a reference threshold. If the high-frequency sound pressure difference d_pow is greater than the reference threshold, the sound-source-direction determining unit 13D determines that the sound source is located at a position facing the upper surface of the housing 18, that is, above the housing 18. If the high-frequency sound pressure difference d_pow is equal to or less than the reference threshold, the sound-source-direction determining unit 13D determines that the sound source is located at a position facing the front surface of the housing 18, that is, in front of the housing 18.

When the high-frequency sound pressure difference d_pow is determined, the spectral power for the second microphone 12 for which the opening 12O is provided at the front surface of the housing 18 is used as a reference in Equation (5). However, as indicated by Equation (6), the determination result changes in the case where the high-frequency sound pressure difference d_pow is determined by using, as the reference, the spectral power for the first microphone 11 for which the opening 11O is provided at the upper surface of the housing 18.

$$d_\text{pow}=(\Sigma_{i=1}^{F-1}10\ \log_{10}(\text{pow2}[i]/\text{pow1}[i])/((F-1)-s) \tag{6}$$

The sound-source-direction determining unit 13D compares the high-frequency sound pressure difference d_pow with the reference threshold. If the high-frequency sound pressure difference d_pow is greater than the reference threshold, the sound-source-direction determining unit 13D determines that the sound source is located at a position facing the front surface of the housing 18, that is, in front of the housing 18. If the high-frequency sound pressure difference d_pow is equal to or less than the reference threshold, the sound-source-direction determining unit 13D determines that the sound source is located at a position facing the upper surface of the housing 18, that is, above the housing 18.

Note that Equations (5) and (6) used to determine the high-frequency sound pressure difference are merely examples and the first embodiment is not limited to these equations. Further, the example has been described in which the high-frequency sound pressure difference, which is a difference between sound pressure of a high-frequency component of sound acquired by the first microphone 11 and sound pressure of the high-frequency component of the sound acquired by the second microphone 12, is used. However, the first embodiment is not limited to this example.

A difference between sound pressure of a certain frequency component of sound acquired by the first microphone 11 and sound pressure of the certain frequency component of the sound acquired by the second microphone 12 may be used instead of the high-frequency sound pressure difference. The certain frequency component may be a high-frequency component or a frequency component for which the sound pressure difference appears markedly between the first microphone 11 and the second microphone 12 depending on the direction of the sound source.

The updating unit 14 updates the reference threshold. The sound pressure difference changes depending on the size of a gap between the body of a wearer and the information processing terminal 1. Thus, the direction of the sound source may be erroneously determined if a fixed threshold is used to determine the direction of the sound source. The size of the gap between the body of the wearer and the information processing terminal 1 changes depending on the posture or the like of the wearer.

The updating unit 14 updates the reference threshold based on a sound pressure difference of sound collected when synthesized sound is reproduced. In the case where a synthesized-sound output control unit 14A performs control so that synthesized sound is output from the speaker 15, the high-frequency sound pressure difference calculated by the high-frequency sound-pressure-difference calculating unit 13C is output to a reference threshold updating unit 14B instead of being output to the sound-source-direction determining unit 13D.

The reference threshold updating unit 14B updates the reference threshold such that the reference threshold increases as the sound pressure difference of the sound collected when the synthesized sound is reproduced increases. Specifically, for example, as indicated by Equation (7), the reference threshold updating unit 14B updates the reference threshold by adding, to an initial threshold TH, a value obtained by subtracting a minimum sound pressure difference DX_MIN obtained when the synthesized sound is reproduced from an average sound pressure dx of the synthesized sound interval and by multiplying the subtraction result by a correction coefficient a. The correction coefficient varies depending on the positions of the speaker 15, the first microphone 11, and the second microphone 12. The correction coefficient may be experimentally determined in advance. The initial threshold TH may be equal to 0.0 [dB], for example. The minimum sound pressure difference DX_MIN may be equal to 3.0 [dB], for example. The correction coefficient a may be equal to 0.75, for example.

$$\text{Reference Threshold}=TH+(dX-DX_MIN)*a \quad (7)$$

The calculations described above may be performed in advance, and the reference thresholds corresponding to the respective average sound pressure differences of the synthesized sound interval may be stored in a table in advance.

Figure 9A:
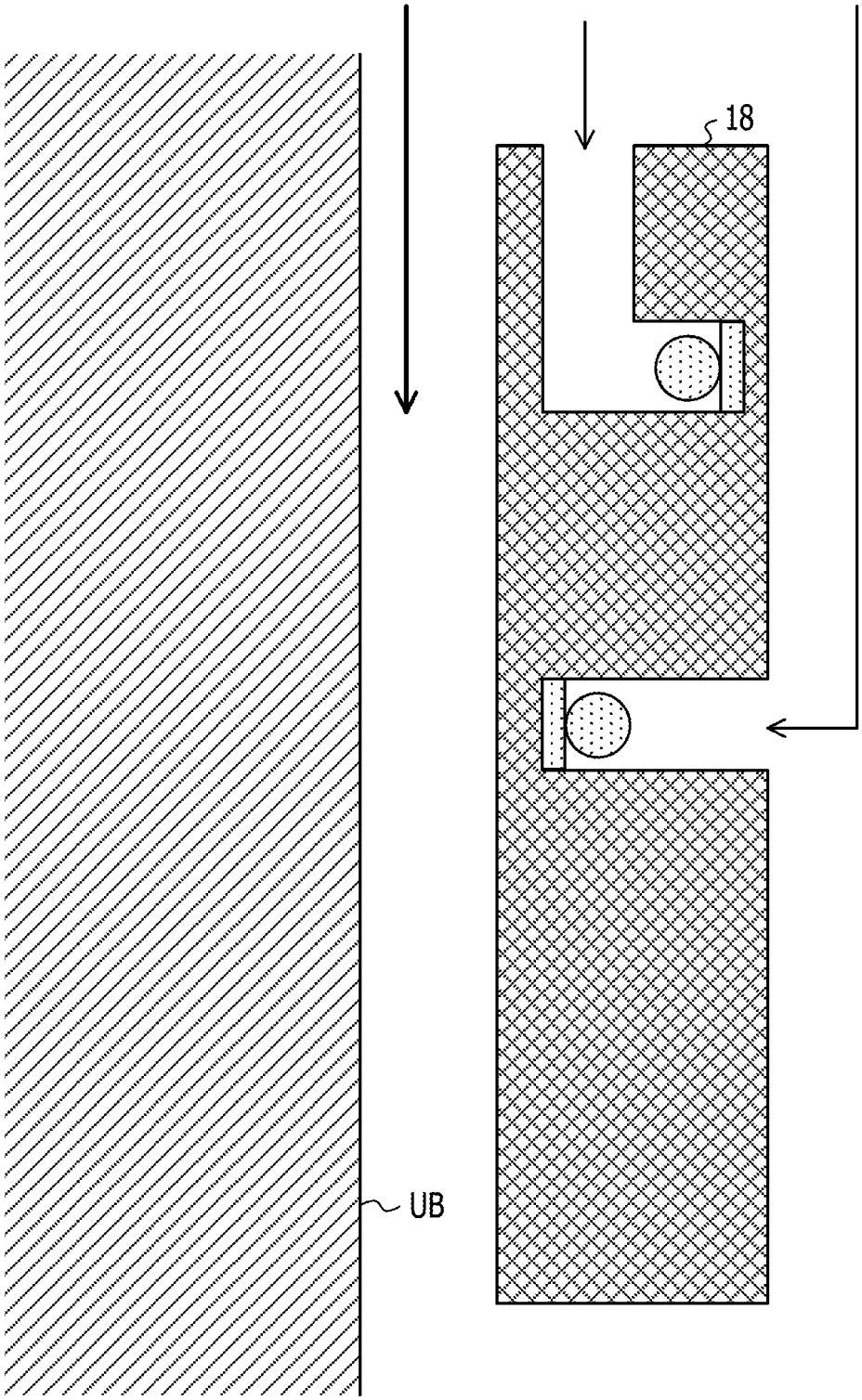
FIG. 9A is a schematic diagram for describing diffraction of sound in the first and second embodiments.
Figure 9B:
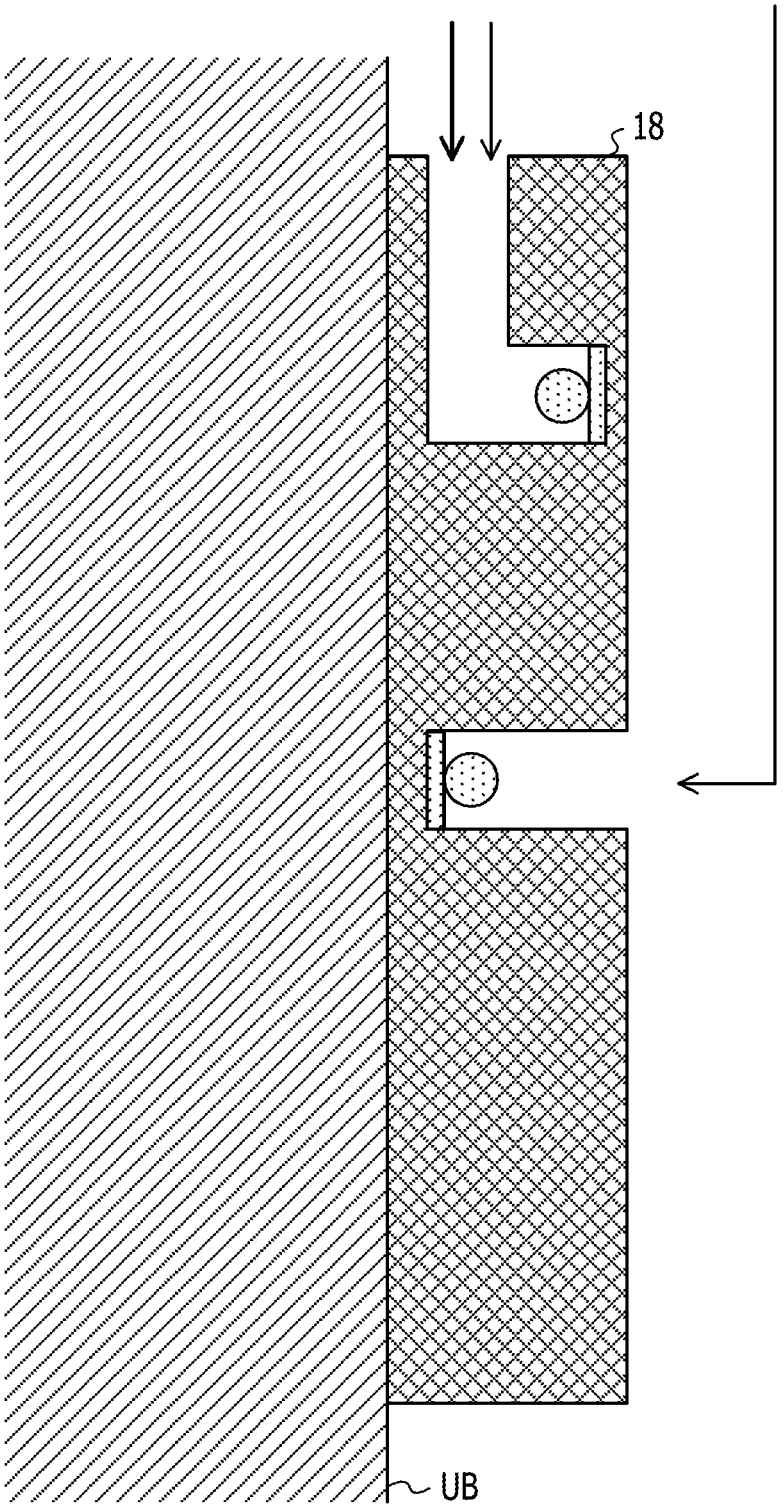
FIG. 9B is a schematic diagram for describing diffraction of sound in the first and second embodiments.

As illustrated in FIG. 9A, when there is a gap between the information processing terminal 1 and a body UB of a wearer, part of sound propagating from the above passes through the gap. Consequently, the sound pressure of sound acquired by the first microphone 11 decreases. That is, the sound pressure difference between the sound pressure of the sound acquired by the first microphone 11 and the sound pressure of the sound acquired by the second microphone 12 is smaller in this case than in the case where there is no gap between the information processing terminal 1 and the body UB of the wearer as illustrated in FIG. 9B. Thus, when there is a gap, the sound pressure difference of sound propagating from the above approaches the sound pressure difference of sound propagating from the front when there is no gap.

Figure 10:
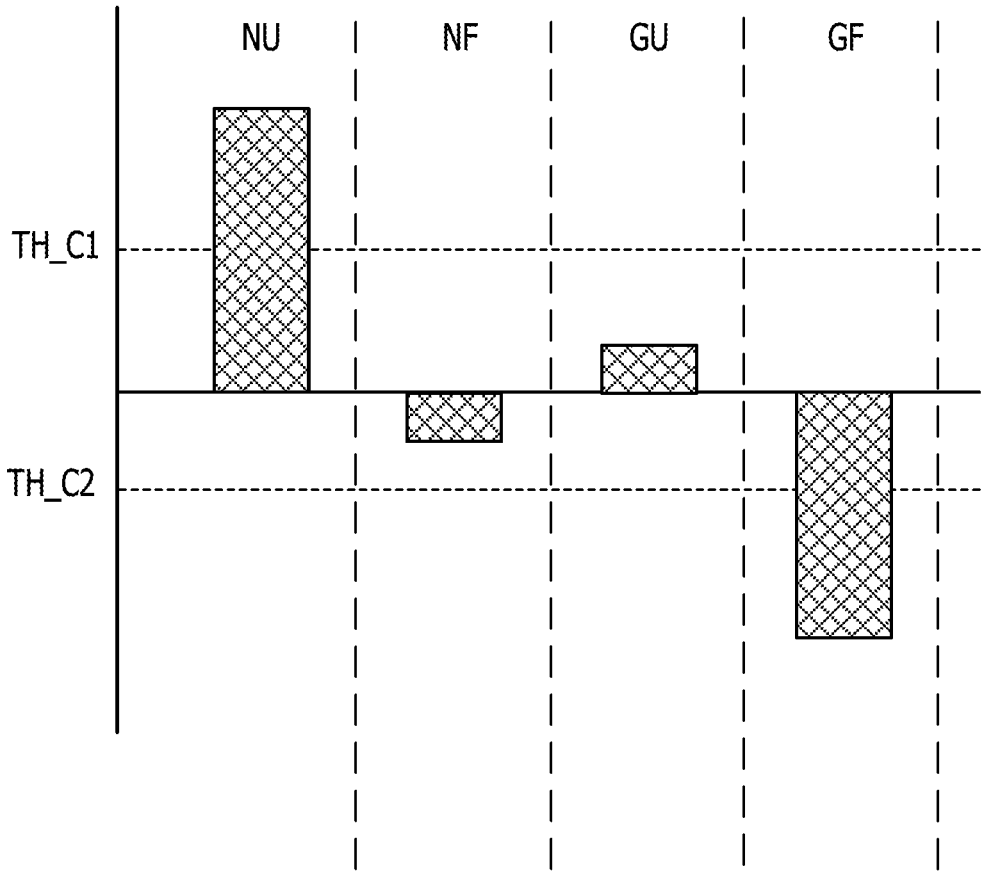
FIG. 10 is a schematic diagram for describing a threshold used to determine the direction in which a sound source is located.

FIG. 10 illustrates sound pressure differences between the first microphone 11 and the second microphone 12 when there is a gap between the information processing terminal 1 and the body UB of the wearer and when there is no gap between the information processing terminal 1 and the body UB of the wearer. FIG. 10 illustrates, from the left, NU which corresponds to the case where the sound source is located above and there is no gap between the information processing terminal 1 and the body UB of the wearer, NF which corresponds to the case where the sound source is located in front and there is no gap, GU which corresponds to the case where the sound source is located above and there is a gap, and GF which corresponds to the case where the sound source is located in front and there is a gap.

When the threshold is set to TH_CH1, the sound pressure difference obtained in the case GU where the sound source is located above and there is a gap is less than the threshold TH_CH1. Thus, it is determined that the corresponding sound is sound propagating from the front. On the other hand, when the threshold is set to TH_C2, which is smaller than the threshold TH_C1, the sound pressure difference obtained in the case NF where the sound source is located in front and there is no gap is greater than the threshold TH_C2. Thus, it is determined that the corresponding sound is sound propagating from the above. That is, since the sound pressure of the sound acquired by the first microphone 11 changes depending on the size of the gap between the information processing terminal 1 and the body UB of the wearer, the direction of the sound source may be erroneously determined.

In the first embodiment, the reference threshold is updated by using sound collected when synthesized sound is reproduced so that the direction of the sound source is not erroneously determined depending on the size of the gap between the information processing terminal 1 and the body UB of the wearer. The information processing terminal 1 expectedly reproduces synthesized sound such as guidance and notifications of translation results frequently.

Figure 11A:
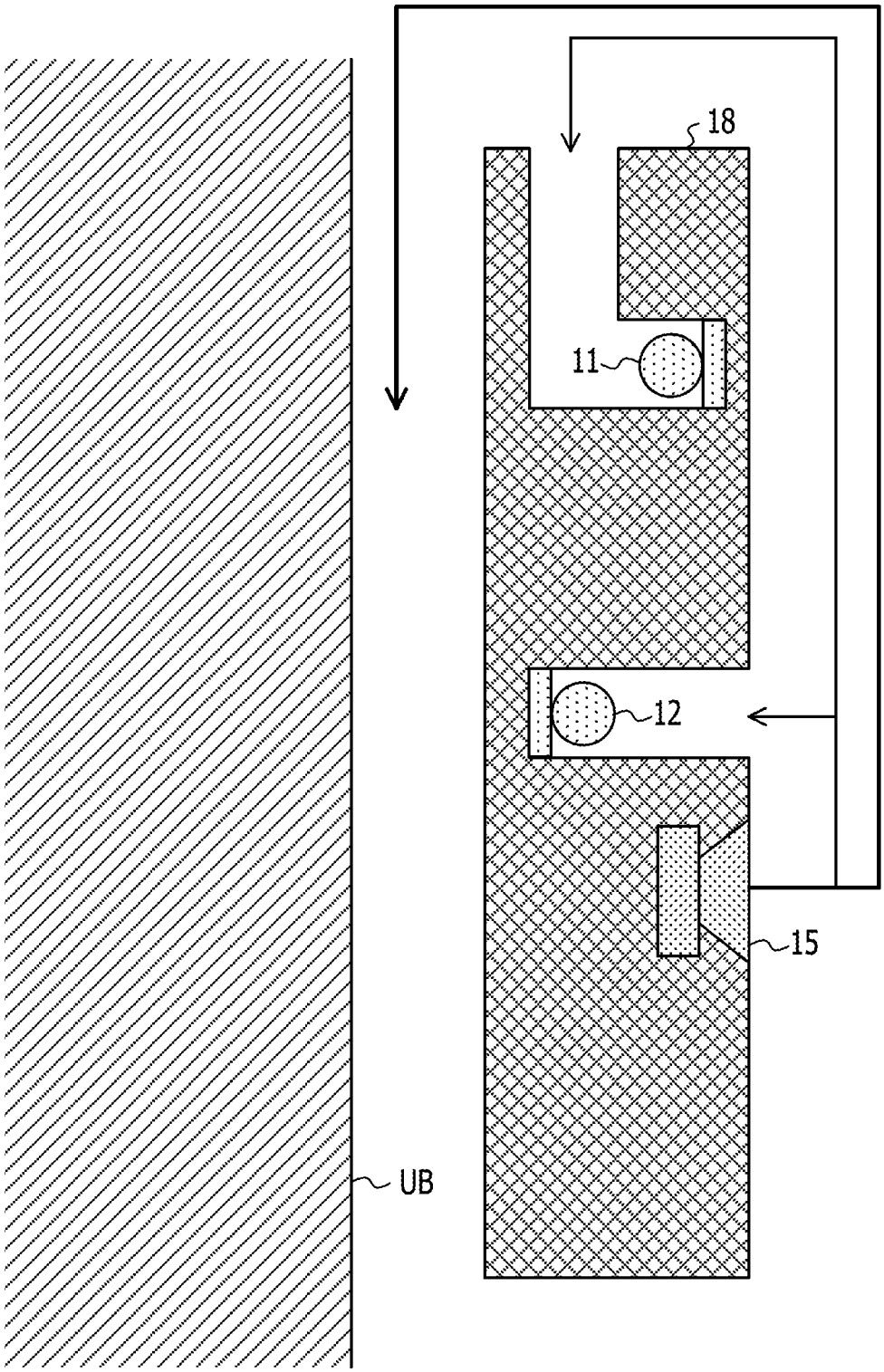
FIG. 11A is a schematic diagram for describing diffraction of synthesized sound in the first and second embodiments.
Figure 11B:
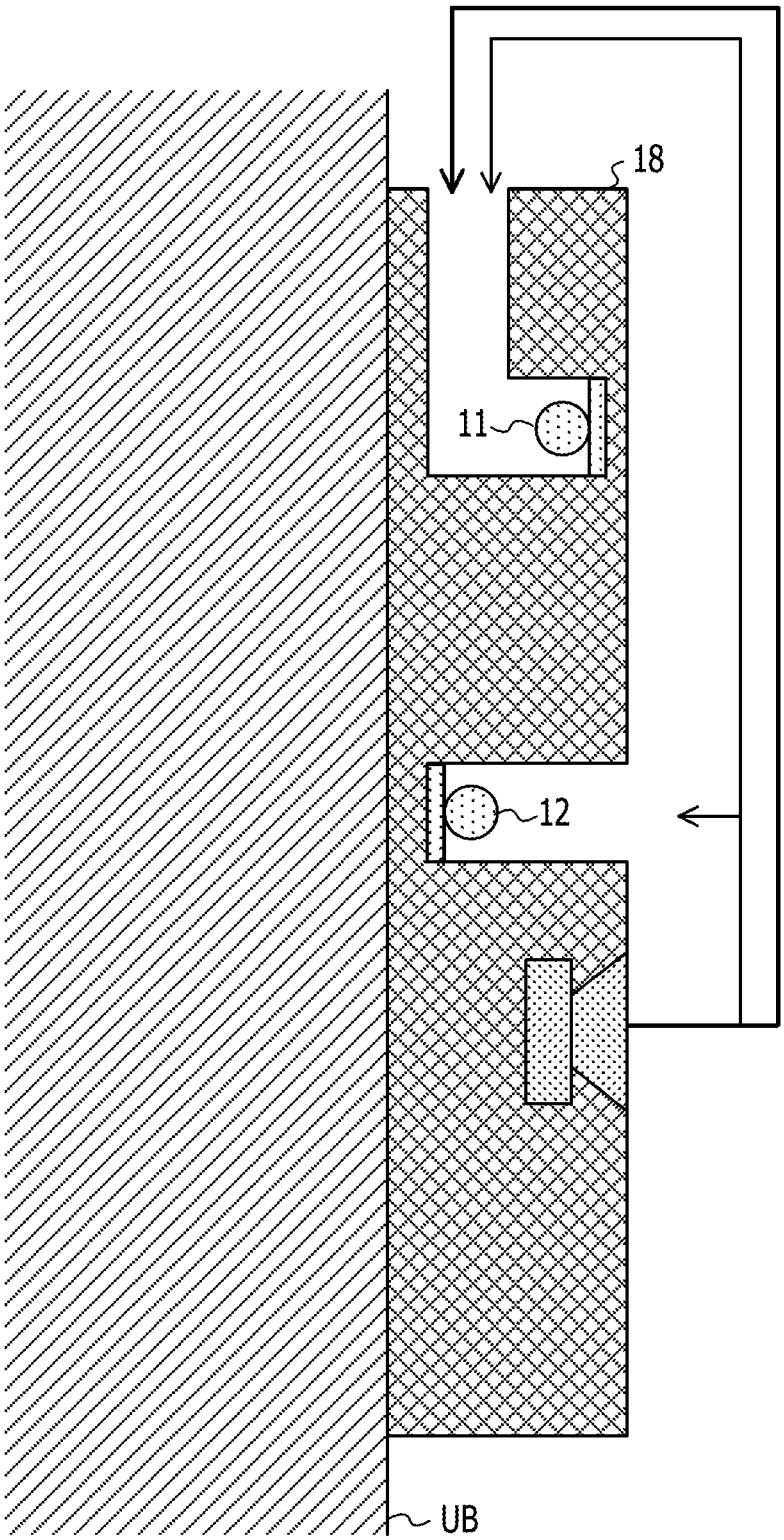
FIG. 11B is a schematic diagram for describing diffraction of synthesized sound in the first and second embodiments.

As illustrated in FIGS. 11A and 11B, synthesized sound reproduced from the speaker 15 during reproduction of the synthesized sound propagates around the housing 18 and is then collected by the first microphone 11 and the second microphone 12. Similarly to the sound collection of the non-synthesized sound, the sound pressure difference between the sound pressure of the sound acquired by the first microphone 11 and the sound pressure of the sound acquired by the second microphone 12 is greater in the case where there is no gap illustrated in FIG. 11B than in the case where there is a gap illustrated in FIG. 11A also for the sound collection performed when the synthesized sound is reproduced.

Sound pressure differences have been measured for the case where there is a gap and the case where there is no gap when five kinds of synthesized sound are reproduced and collected. The result of the measurement has confirmed that a clear difference of 3 [dB] to 5 [dB] exists for the sound pressure differences of the sound collected at the time of reproduction of the synthesized sound in the case where there is a gap and the case where there is no gap. That is, the size of the gap is successfully determined based on the sound pressure difference of sound collected when synthesized sound is reproduced.

Figure 12:
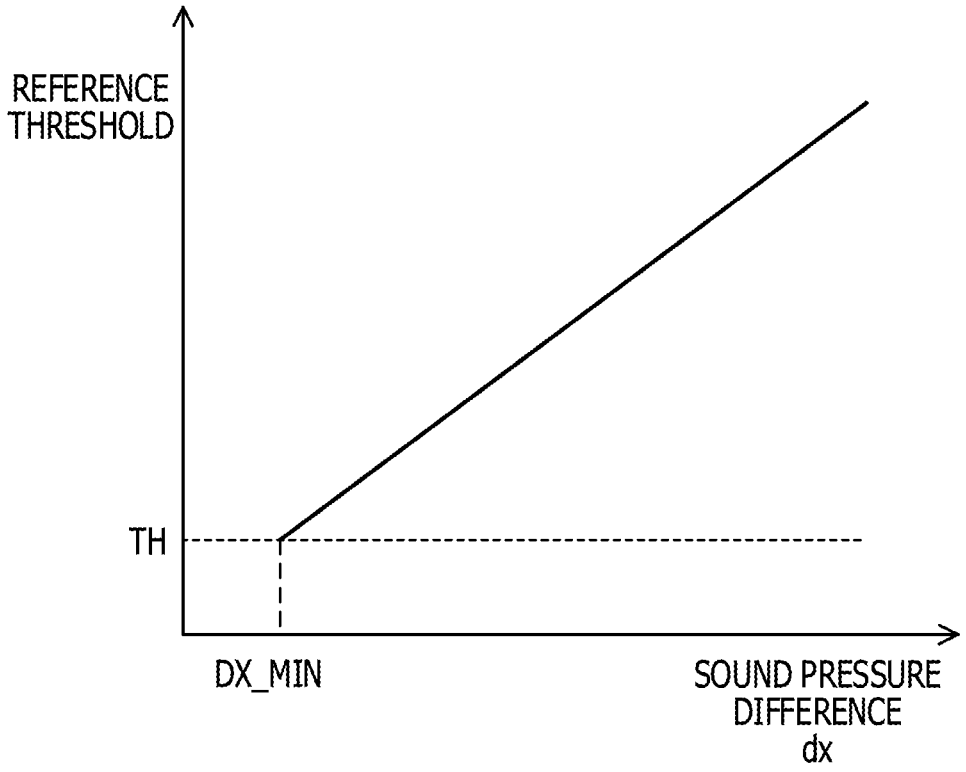
FIG. 12 is a schematic diagram for describing updating of a reference threshold.

Thus, in the first embodiment, the reference threshold is updated by using Equation (7), for example, such that the reference threshold increases as the average sound pressure difference dx of the synthesized sound interval increases as illustrated in FIG. 12. That is, when there is a gap between the information processing terminal 1 and the body UB of the wearer, the average sound pressure difference dx of the synthesized sound interval decreases and the average sound pressure difference of an utterance interval also decreases. Thus, the reference threshold is decreased. When there is no gap between the information processing terminal 1 and the body UB of the wearer, the average sound pressure difference dx of the synthesized sound interval increases and the average sound pressure difference of the utterance interval also increases. Thus, the reference threshold is increased.

Figure 13:
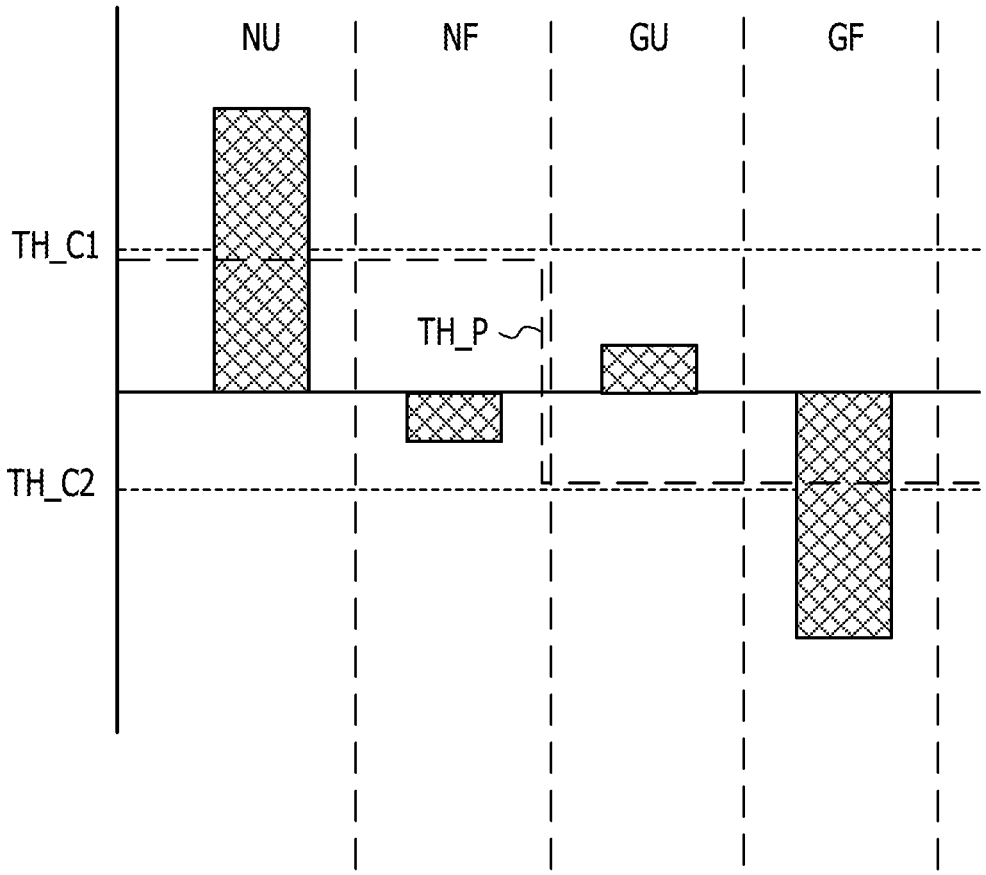
FIG. 13 is a schematic diagram for describing updating of the reference threshold.

FIG. 13 illustrates an example of a reference threshold TH_P updated based on the average sound pressure difference of the synthesized sound interval. As illustrated in FIG. 14, in the case where the reference threshold is fixed to TH_C1, it is determined that the sound source is located in front when the sound source is located above and there is a gap. In the case where the reference threshold is fixed to TH_C2, it is determined that the sound source is located above when the sound source is located in front and there is no gap. However, by changing the reference threshold TH_P based on the average sound pressure difference of the synthesized sound interval, the direction of the sound source may be appropriately determined even if the size of the gap changes.

Figure 15:
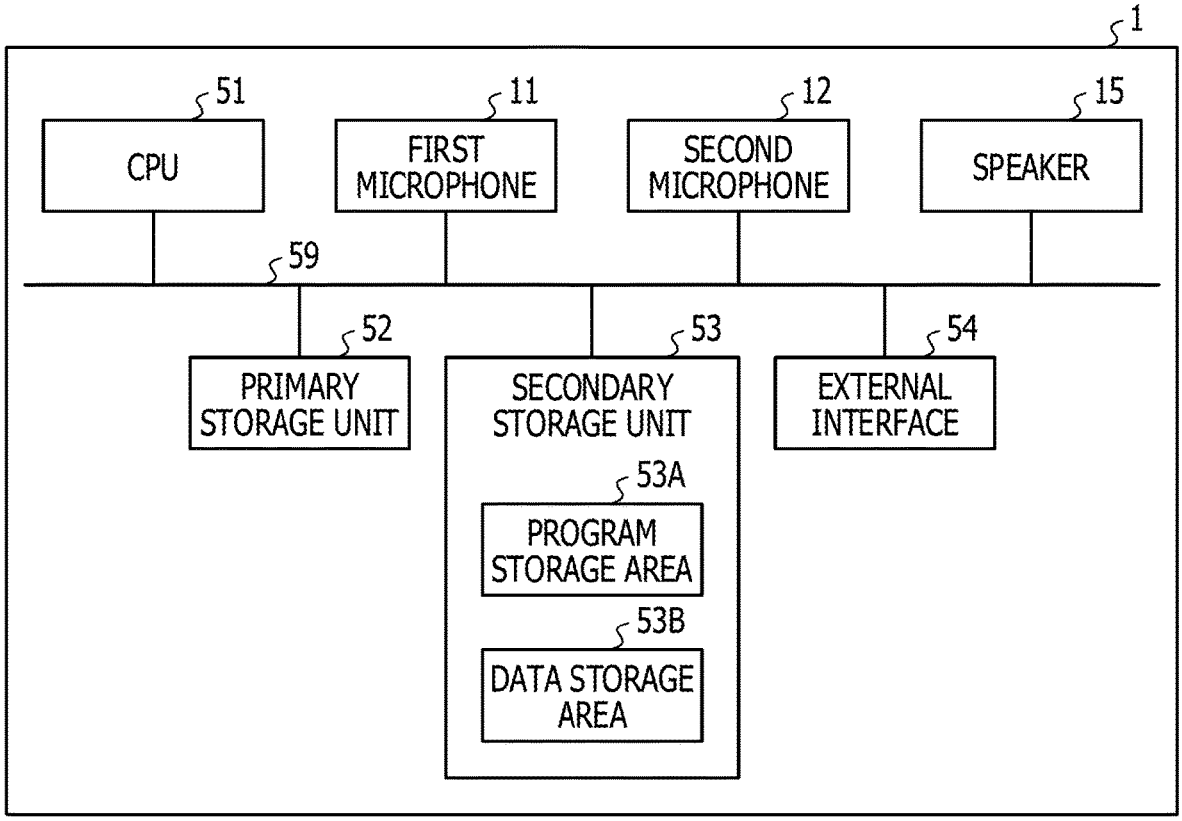
FIG. 15 is a block diagram illustrating an example of hardware of the information processing terminal according to the first to third embodiments.

FIG. 15 illustrates an example of a hardware configuration of the information processing terminal 1. The information processing terminal 1 includes a central processing unit (CPU) 51 which is an example of a processor that is hardware, a primary storage unit 52, a secondary storage unit 53, and an external interface 54. The information processing terminal 1 also includes the first microphone 11, the second microphone 12, and the speaker 15.

The CPU 51, the primary storage unit 52, the secondary storage unit 53, the external interface 54, the first microphone 11, the second microphone 12, and the speaker 15 are connected to each other via a bus 59.

The primary storage unit 52 is, for example, a volatile memory such as a random access memory (RAM).

The secondary storage unit 53 includes a program storage area 53A and a data storage area 53B. The program storage area 53A stores, by way of example, programs such as a sound-source-direction determining program and a speech translating program. The sound-source-direction determining program causes the CPU 51 to execute the sound-source-direction determining process. The speech translating program causes the CPU 51 to execute a speech translating process based on the determination result obtained in the sound-source-direction determining process. The data storage area 53B stores sound signals corresponding to sound acquired by the first microphone 11 and the second microphone 12, intermediate data temporarily generated in the sound-source-direction determining process and the speech translating process, and so forth.

The CPU 51 reads out the sound-source-direction determining program from the program storage area 53A and loads the sound-source-direction determining program to the primary storage unit 52. The CPU 51 executes the sound-source-direction determining program to operate as the determining unit 13 and the updating unit 14 illustrated in FIG. 1. The CPU 51 reads out the speech translating program from the program storage area 53A and loads the speech translating program to the primary storage unit 52. The CPU 51 executes the speech translating program to operate as the first translating unit 16A and the second translating unit 16B illustrated in FIG. 1. Note that the programs such as the sound-source-direction determining program and the speech translating program may be stored on a non-transitory recording medium such as a digital versatile disc (DVD), read through a recording medium reading apparatus, and loaded to the primary storage unit 52.

An external device is connected to the external interface 54. The external interface 54 manages transmission and reception of various kinds of information performed between the external device and the CPU 51. For example, the speaker 15 may be an external device that is connected via the external interface 54, instead of being included in the information processing terminal 1.

Figure 16:
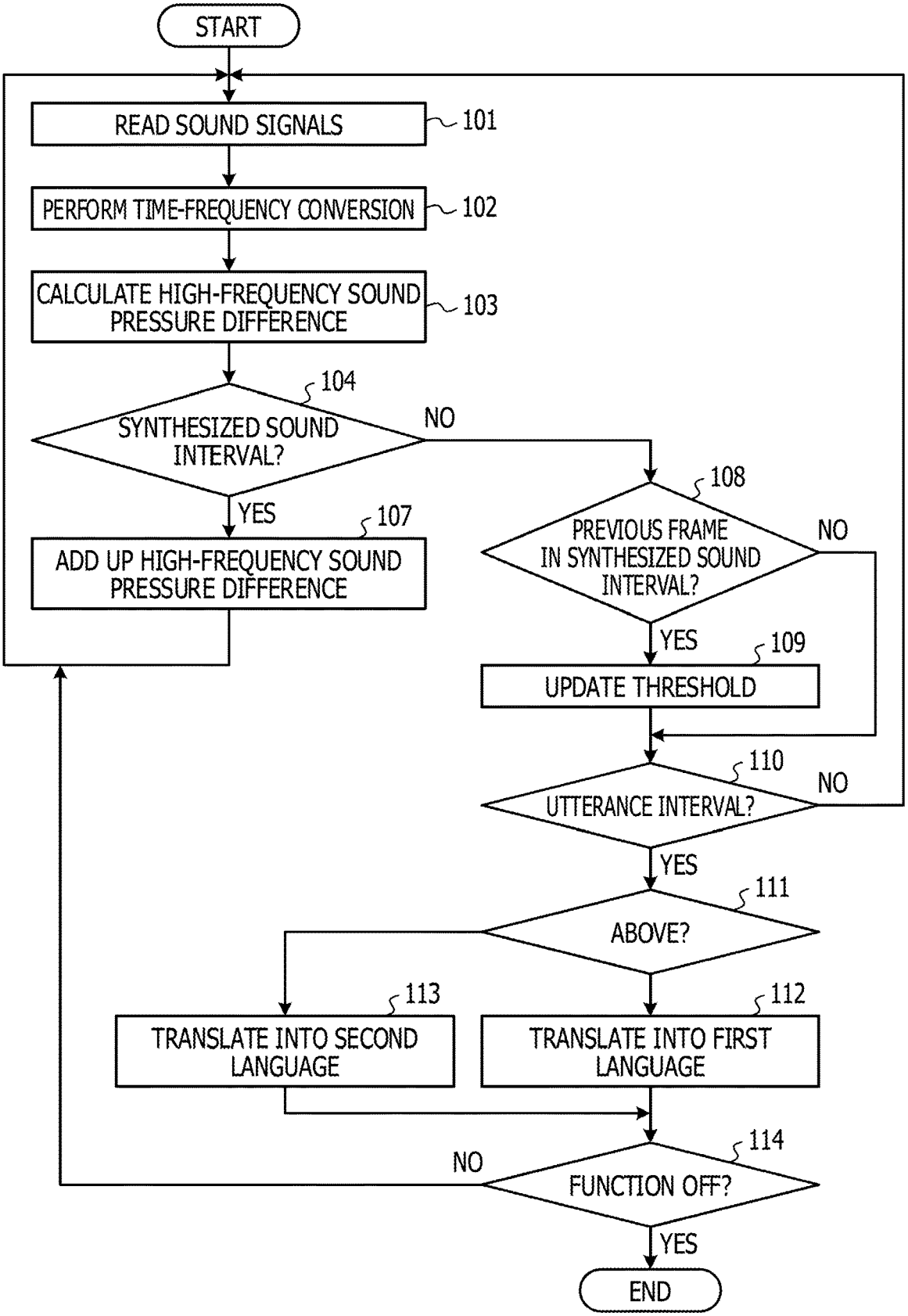
FIG. 16 is a flowchart illustrating an example of a flow of a sound-source-direction determining process according to the first and third embodiments.

An overview of an operation performed by the information processing terminal 1 will be described next. FIG. 16 illustrates the overview of the operation performed by the information processing terminal 1. For example, when a user powers on the information processing terminal 1, the CPU 51 reads sound signals of one frame in step 101. Specifically, the CPU 51 reads a sound signal (hereinafter referred to as a first sound signal) of one frame corresponding to sound acquired by the first microphone 11 and a sound signal (hereinafter referred to as a second sound signal) of one frame corresponding to sound acquired by the second microphone 12. The one frame may be, for example, 32 [milliseconds] when the sampling frequency is equal to 16 [kHz].

In step 102, the CPU 51 performs time-frequency conversion on each of the sound signals read in step 101. In step 103, the CPU 51 calculates the spectral power of each of the sound signals subjected to the time-frequency conversion by using Equations (3) and (4), and calculates the high-frequency sound pressure difference d_pow by using Equation (5).

In step 104, the CPU 51 determines whether or not the sound signals read in step 101 are sound signals of a synthesized sound interval. Since synthesized sound is output under the control of the CPU 51, the CPU 51 may determine whether or not the synthesized sound is being output by the CPU 51.

If the determination in step 104 is YES, the CPU 51 cumulatively adds the high-frequency sound pressure difference d_pow in step 107. The process then returns to step 101. If the determination in step 104 is NO, the CPU 51 determines whether or not the previous frame is in the synthesized sound interval in step 108.

If the determination in step 108 is YES, the CPU 51 calculates in step 109 the average sound pressure difference dx by dividing the cumulative sum of the high-frequency sound pressure difference d_pow calculated in step 107 by the number of frames of the synthesized sound interval for which the cumulative addition has been performed. The CPU 51 updates the reference threshold based on the average sound pressure difference dx by using, for example, Equation (7). The process then proceeds to step 110. If the determination in step 108 is NO, the CPU 51 does not update the reference threshold. The process then proceeds to step 110.

In step 110, the CPU 51 determines whether or not the sound signals read in step 101 are sound signals of an utterance interval. An existing utterance interval determining technique may be used to determine whether or not the target interval is an utterance interval.

If the determination made by the CPU 51 in step 110 is NO, the process returns to step 101. If the determination in step 110 is YES, the CPU 51 compares in step 111 the high-frequency sound pressure difference d_pow calculated in step 103 with the reference threshold updated in step 109. If the high-frequency sound pressure difference d_pow is greater than the reference threshold, the CPU 51 determines that the sound source is located above the information processing terminal 1. The process then proceeds to step 112. In step 112, the CPU 51 distributes the sound signals to a process of translating a second language into a first language. The process then proceeds to step 114. The distributed sound signals are translated from the second language into the first language by using an existing speech translation processing technology. The result is output as voice from the speaker 15, for example.

If it is determined that the high-frequency sound pressure difference d_pow is equal to or less than the reference threshold, the CPU 51 determines that the sound source is located in front of the information processing terminal 1 in step 111. In step 113, the CPU 51 distributes the sound signals to a process of translating the first language into the second language. The process then proceeds to step 114. The distributed sound signals are translated from the first language into the second language by using an existing speech translation processing technology. The result is output as voice from the speaker 15, for example.

In step 114, the CPU 51 determines whether or not the sound-source-direction determining function of the information processing terminal 1 is turned off by a user operation, for example. If the determination in step 114 is NO, that is, if the sound-source-direction determining function is ON, the process returns to step 101. In step 101, the CPU 51 reads sound signals of the next frame and continues the sound-source-direction determining process. If the determination in step 114 is NO, that is, if the sound-source-direction determining function is OFF, the CPU 51 ends the sound-source-direction determining process.

The case where the speech translating apparatus 16 is included in the housing 18 of the information processing terminal 1 together with the sound-source-direction determining apparatus 10 has been described. However, the first embodiment is not limited to this configuration. For example, the speech translating apparatus 16 may be located outside the housing 18 of the information processing terminal 1 and may be connected to the sound-source-direction determining apparatus 10 via a wired or wireless link.

If the high-frequency sound pressure difference d_pow is greater than the reference threshold, it is determined in step 111 that the sound source is located above the information processing terminal 1. If the high-frequency sound pressure difference d_pow is equal to or less than the reference threshold, it is determined that the sound source is located in front of the information processing terminal 1. Such an example has been described. However, the first embodiment is not limited to this example.

For example, if the high-frequency sound pressure difference d_pow is greater than a reference threshold+DT, it may be determined that the sound source is located above the information processing terminal 1. If the high-frequency sound pressure difference d_pow is less than a reference threshold −DT, it may be determined that the sound source is located in front of the information processing terminal 1. In this case, if the high-frequency sound pressure difference d_pow is equal to or less than the reference threshold+DT and is equal to or greater than the reference threshold −DT, the direction of the sound source is not determined. DT may be equal to, for example, 0.5 [dB]. This configuration may further reduce the possibility that the direction of the sound source is erroneously determined.

In the first embodiment, a sound-source-direction determining apparatus includes a microphone disposed portion having therein a first sound path and a second sound path. The first sound path has a first opening at one end thereof. The first opening is open at a first flat surface. Sound propagates through the first sound path from the first opening. The second sound path has a second opening at one end thereof. The second opening is open at a second flat surface that intersects with the first flat surface. Sound propagates through the second sound path from the second opening. The sound-source-direction determining apparatus further includes a first microphone, a second microphone, and a speaker. The first microphone is omnidirectional and is disposed at or in the vicinity of the other end of the first sound path. The second microphone is omnidirectional and is disposed at or in the vicinity of the other end of the second sound path. The speaker outputs synthesized sound. An updating unit updates a reference threshold such that the reference threshold increases as a sound pressure difference increases. The sound pressure difference is a difference between sound pressure of a certain frequency component of sound acquired by the first microphone and sound pressure of the certain frequency component of the sound acquired by the second microphone when the synthesized sound is output from the speaker. A determining unit determines a direction in which a sound source of sound is located, based on comparison between the reference threshold and a sound pressure difference between sound pressure of a certain frequency component of the sound acquired by the first microphone and sound pressure of the certain frequency component of the sound acquired by the second microphone when the synthesized sound is not output from the speaker.

According to the first embodiment, with the above-described configuration, the accuracy of determining the direction of the sound source by using omnidirectional microphones is successfully increased, regardless of the size of a gap between the information processing terminal and the body of a wearer.

Second Embodiment

An example of a second embodiment will be described next. The description of the configuration and operation that are substantially the same as those of the first embodiment will be omitted.

In the second embodiment, the reference threshold is updated by using a sound pressure difference of synthesized sound of a frame that is less affected by noise. If sound other than synthesized sound, that is, noise is present in a synthesized sound interval, the sound pressure difference of the synthesized sound is not appropriately obtained. Consequently, the reference threshold is not appropriately updated. The noise is, for example, sound generated by an utterance of an interaction partner.

Figure 17A:
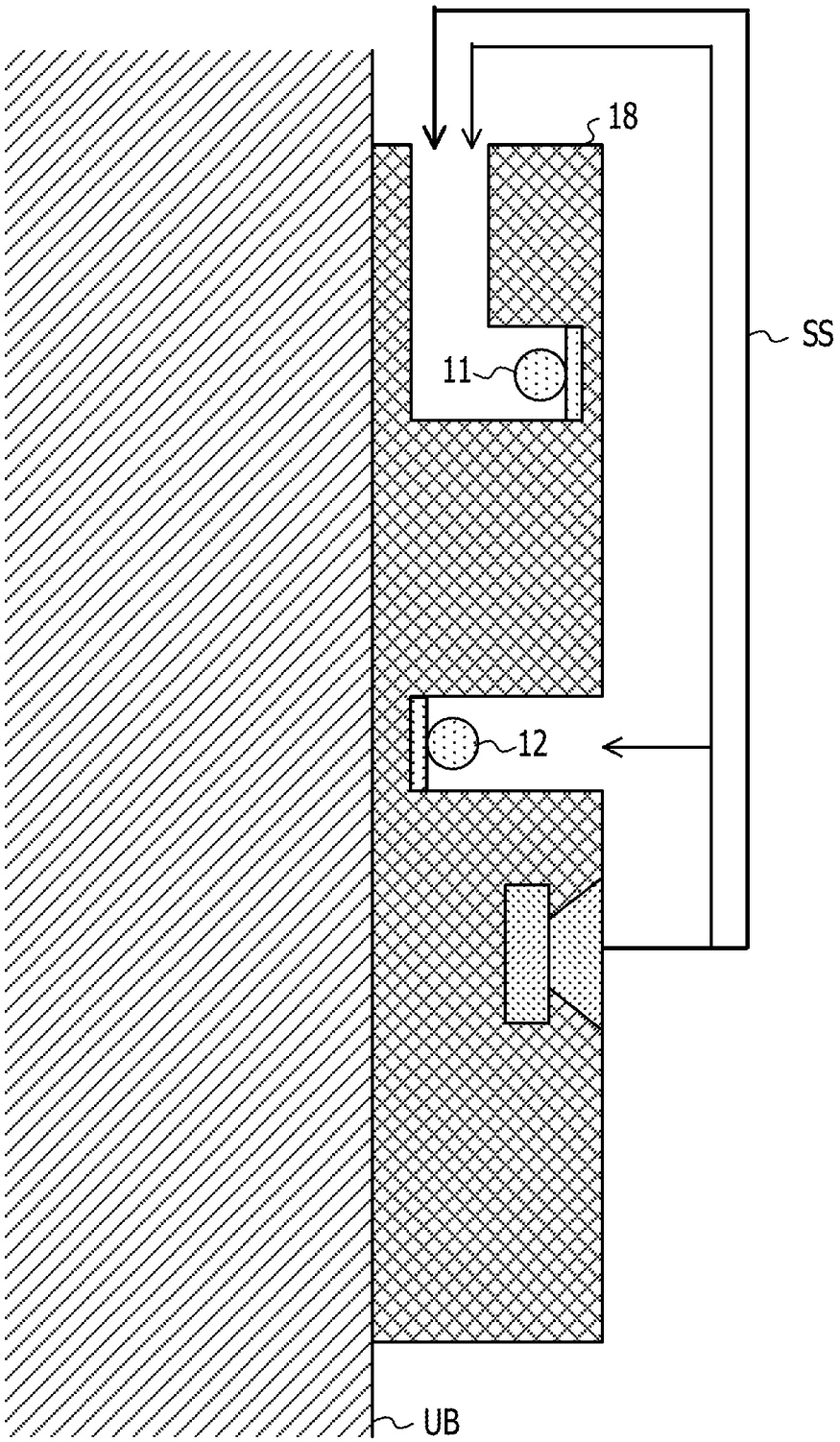
FIG. 17A is a schematic diagram for describing diffraction of synthesized sound in the first and second embodiments.
Figure 17B:
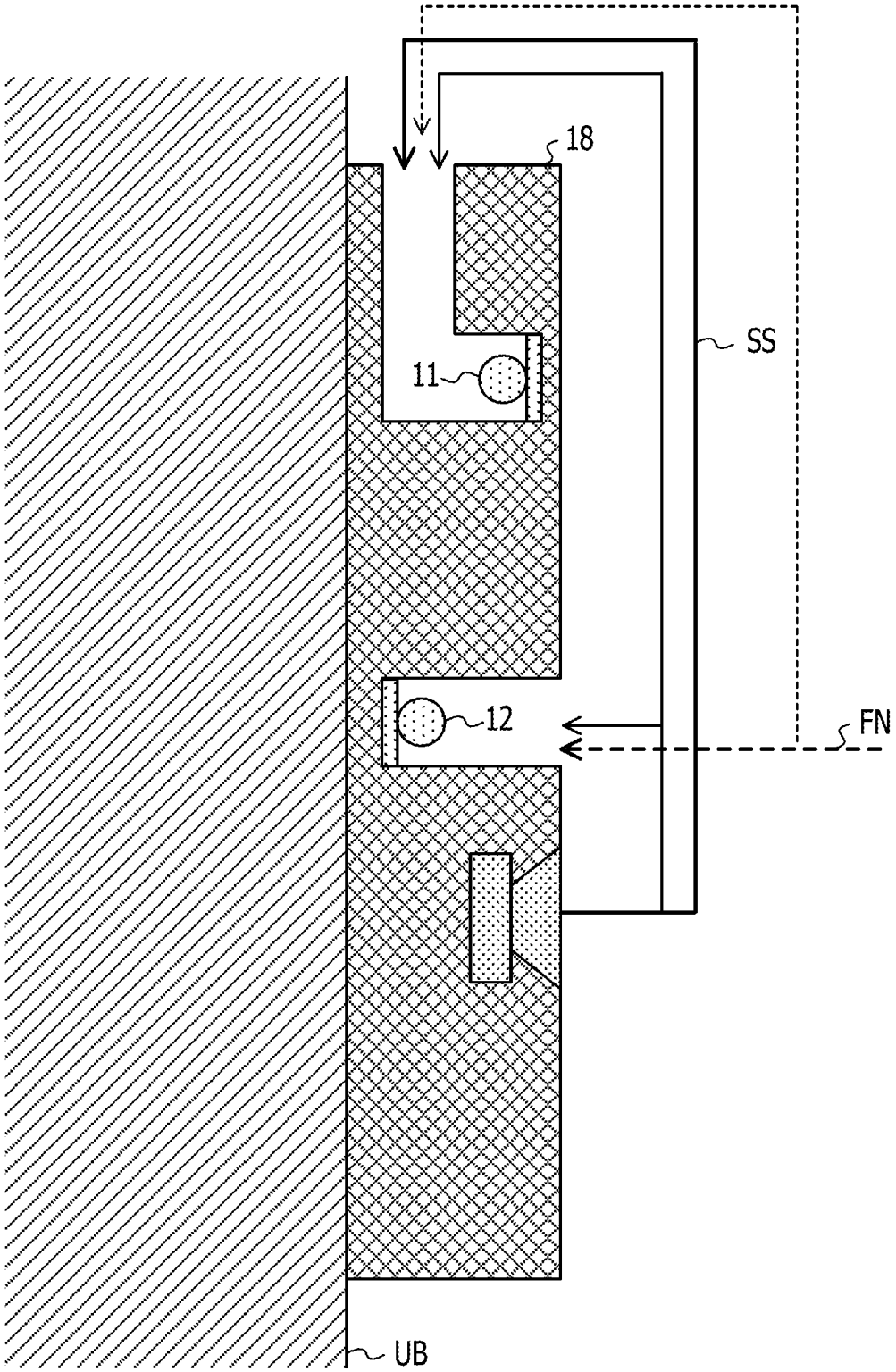
FIG. 17B is a schematic diagram for describing diffraction of synthesized sound and noise in the first and second embodiments.

As illustrated in FIG. 17A, the first microphone 11 and the second microphone 12 collect synthesized sound SS output from the speaker 15. As illustrated in FIG. 17B, if noise FN propagating from the front is present while the synthesized sound SS is being reproduced, the sound pressure for the second microphone 12 increases. Consequently, the sound pressure difference between the sound pressure of the sound acquired by the first microphone 11 and the sound pressure of the sound acquired by the second microphone 12 decreases.

Therefore, even if the reference threshold is updated by using the sound pressure difference between the sound pressure of the sound acquired by the first microphone 11 and the sound pressure of the sound acquired by the second microphone 12 in the synthesized sound interval, an appropriate reference threshold may not be obtained.

Figure 18A:
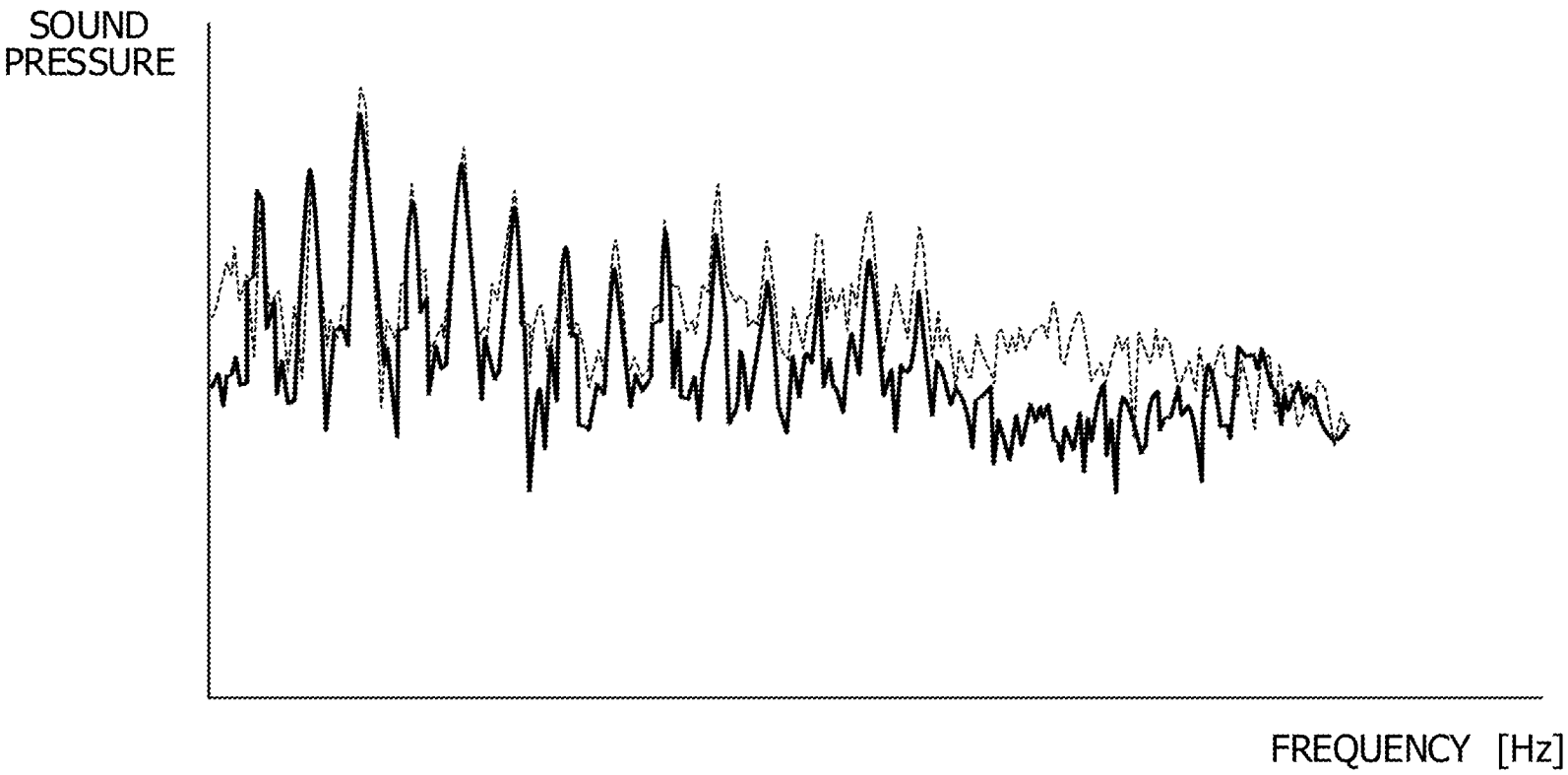
FIG. 18A is a schematic diagram illustrating an example of frequency spectra of synthesized sound and sound collected by a first microphone in the case where noise is absent.
Figure 18B:
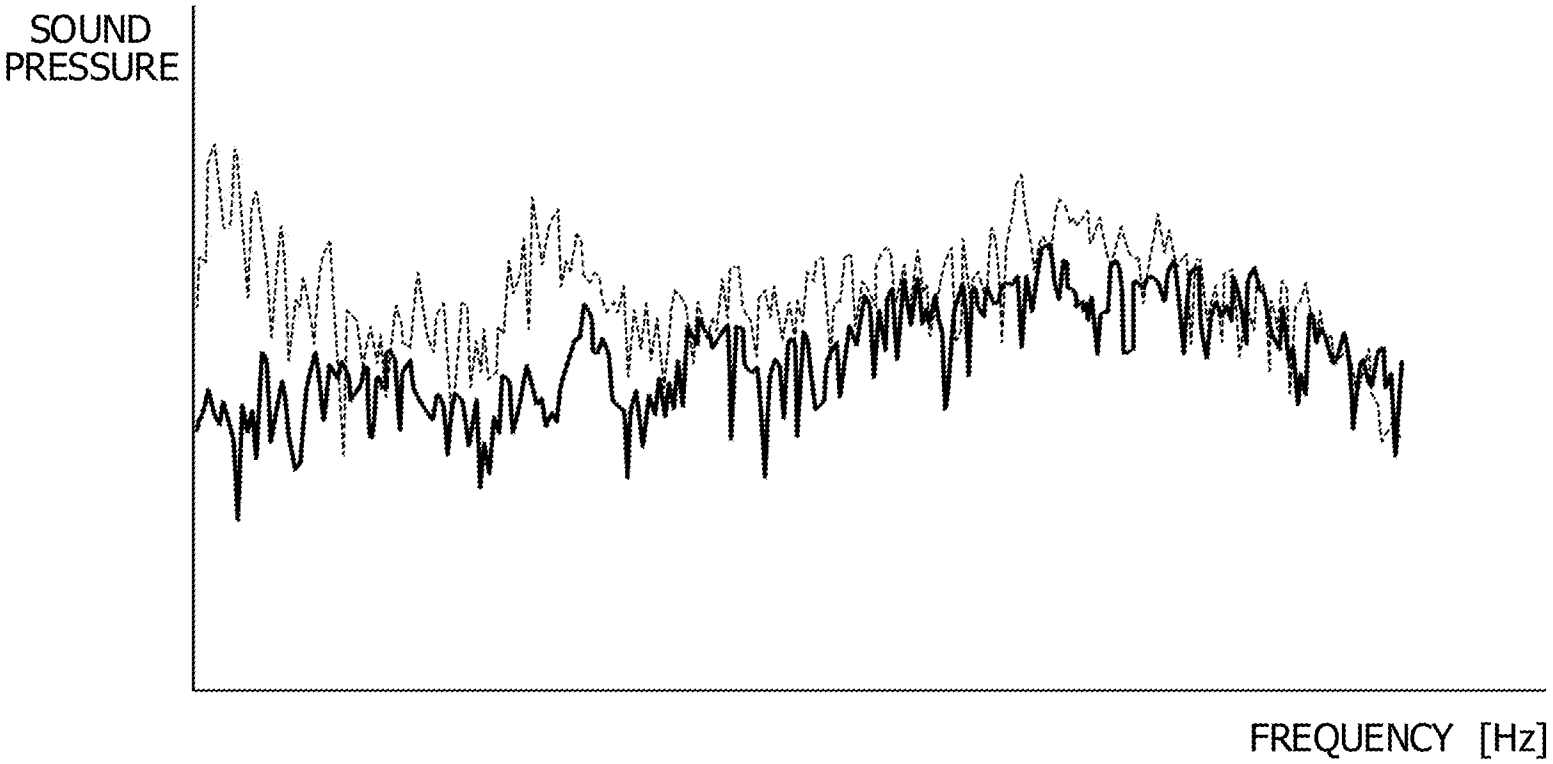
FIG. 18B is a schematic diagram illustrating an example of frequency spectra of synthesized sound and sound collected by the first microphone in the case where noise is present.

In FIGS. 18A and 18B, a frequency spectrum of sound collected by the first microphone 11 is denoted by a broken line and a frequency spectrum of synthesized sound is denoted by a solid line. FIG. 18A illustrates the case where noise is absent. FIG. 18B illustrates the case where noise is present. The similarity between the collected sound and the synthesized sound is higher in the case where noise is absent than in the case where noise is present.

Figure 19:
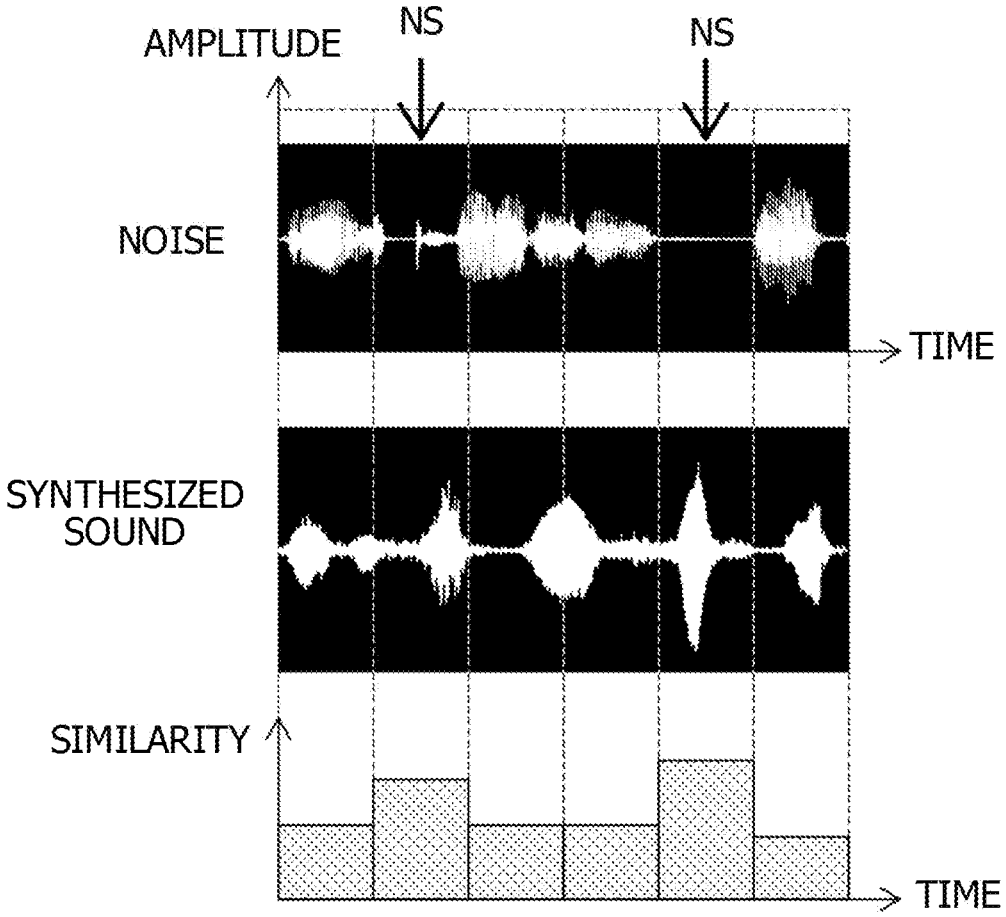
FIG. 19 is a schematic diagram illustrating an example of a relationship among noise, synthesized sound, and the similarity between frequency spectra of the synthesized sound and sound collected by the first microphone.

The top chart of FIG. 19 illustrates a frequency spectrum of the noise, the middle chart of FIG. 19 illustrates a frequency spectrum of the synthesized sound, and the bottom chart of FIG. 19 illustrates the similarity between the sound collected by the first microphone 11 and the synthesized sound. In frames NS in which the noise is small, the similarity between the collected sound and the synthesized sound is high. In the second embodiment, the reference threshold is updated by using the frame NS in which the similarity between the synthesized sound and each of the sound collected by the first microphone 11 and the sound collected by the second microphone 12 is high.

The reference threshold updating unit 14B illustrated in FIG. 8 is capable of calculating a similarity d1 between the sound collected by the first microphone 11 and the synthesized sound, output of which is controlled by the synthesized-sound output control unit 14A, and a similarity d2 between the sound collected by the second microphone 12 and the synthesized sound, by using frequency spectra of the sound collected by the first microphone 11, the sound collected by the second microphone 12, and the synthesized sound. In this case, the similarities d1 and d2 are calculated by using, for example, Equation (8), based on the spectral power calculated from the frequency spectra.

$$d1 = \frac{\sum_{i=0}^{F-1}(pow1[i]-pow1ave)(pows[i]-powsave)}{\sqrt{\sum_{i=0}^{F-1}(pow1[i]-pow1ave)^2\sum_{i=0}^{F-1}(pows[i]-powsave)^2}} \tag{8}$$

$$pow1ave = \frac{\sum_{i=0}^{F-1} pow1[i]}{F}$$

$$pows[bin] = res[bin]^2 + ims[bin]^2$$

$$powsave = \frac{\sum_{i=0}^{F-1} pows[i]}{F}$$

$$d2 = \frac{\sum_{i=0}^{F-1}(pow2[i]-pow2ave)(pows[i]-powsave)}{\sqrt{\sum_{i=0}^{F-1}(pow2[i]-pow2ave)^2\sum_{i=0}^{F-1}(pows[i]-powsave)^2}}$$

$$pow2ave = \frac{\sum_{i=0}^{F-1} pow2[i]}{F}$$

In Equation (8), res[bin] denotes the real part of the frequency spectrum of the frequency band bin, which is obtained when the sound signal of the synthesized sound is subjected to the time-frequency conversion. In addition, ims[bin] denotes the imaginary part of the frequency spectrum of the frequency band bin, which is obtained when the sound signal of the synthesized sound is subjected to the time-frequency conversion. Data of the synthesized sound is stored in the data storage area 53B. Data corresponding to a frame of the synthesized sound, output of which is controlled by the synthesized-sound output control unit 14B, is used.

The similarities d1 and d2 are calculated by using all the frequency bands, that is, i=0 to 255. However, the similarities d1 and d2 may be calculated by using frequency bands excluding a low-frequency component such as a direct-current frequency component, for example. The inner product may be used to calculate the similarities d1 and d2 as indicated by the Equation (9).

$$d1=\Sigma_{i=0}^{F-1}\mathrm{pow1}[i]\cdot\mathrm{pows}[i]$$

$$d2=\Sigma_{i=0}^{F-1}\mathrm{pow2}[i]\cdot\mathrm{pows}[i] \tag{9}$$

The covariance may be used to calculate the similarities d1 and d2 as indicated by Equation (10).

$$d1=\Sigma_{i=0}^{F-1}(\mathrm{pow1}[i]-\mathrm{pow1ave})(\mathrm{pows}[i]-\mathrm{powsave})$$

$$d2=\Sigma_{i=0}^{F-1}(\mathrm{pow2}[i]-\mathrm{pow2ave})(\mathrm{pows}[i]-\mathrm{powsave}) \tag{10}$$

Figure 20:
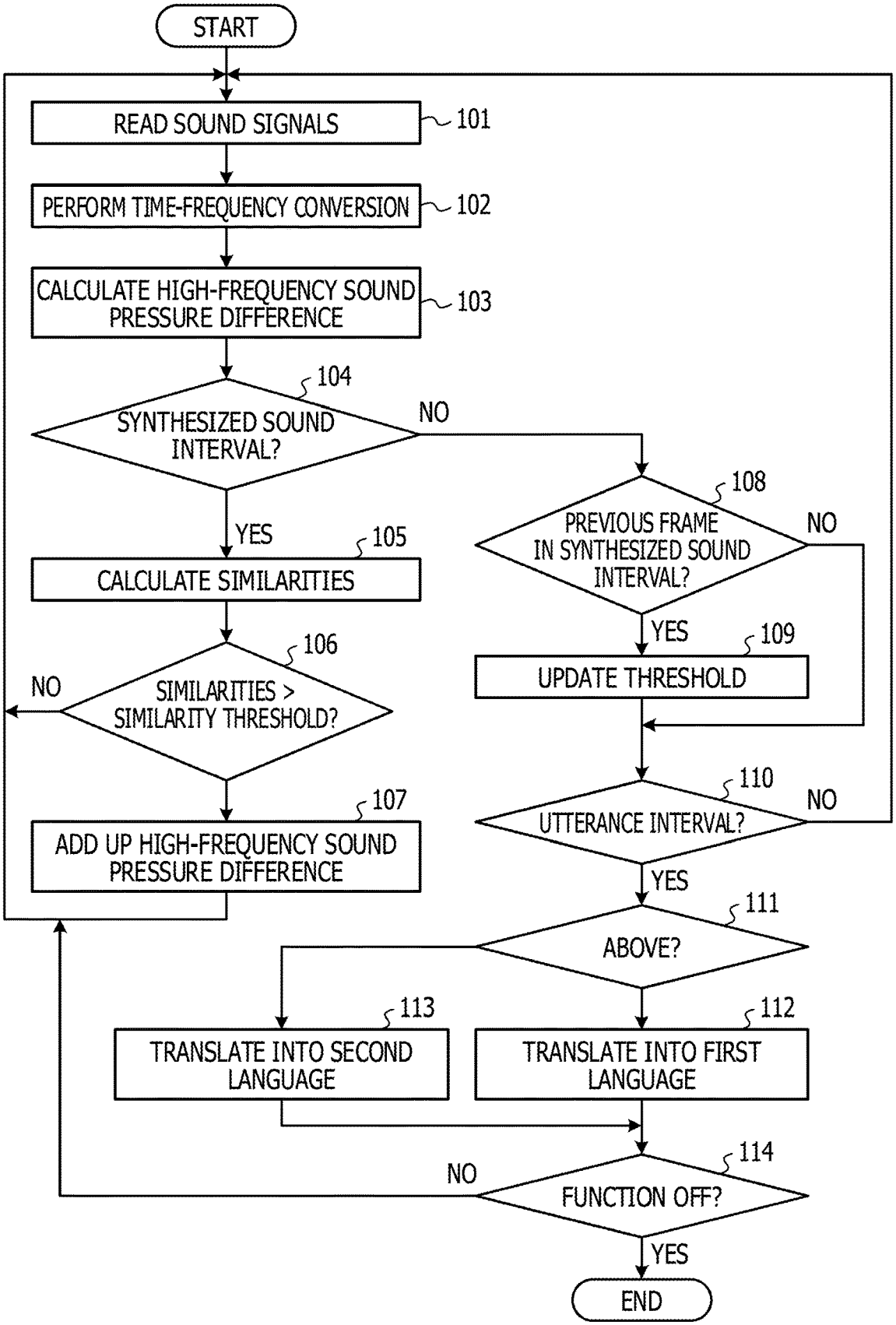
FIG. 20 is a flowchart illustrating an example of a flow of a sound-source-direction determining process according to the second and third embodiments.

An overview of an operation performed by the sound-source-direction determining apparatus 10 included in the information processing terminal 1 will be described next. FIG. 20 illustrates the overview of the operation performed by the sound-source-direction determining apparatus 10. FIG. 20 differs from the flowchart of FIG. 16 in that FIG. 20 further includes steps 105 and 106.

In step 105, the CPU 51 calculates the similarity d1 between the sound collected by the first microphone 11 and the synthesized sound and the similarity d2 between the sound collected by the second microphone 12 and the synthesized sound by using, for example, Equation (8). In step 106, the CPU 51 determines whether or not both of the similarities d1 and d2 exceed a certain similarity threshold. The certain similarity threshold may be equal to, for example, 0.6.

If the determination made by the CPU 51 in step 106 is YES, the process proceeds to step 107. If the determination made by the CPU 51 in step 106 is NO, the process returns to step 101.

In the second embodiment, the updating unit calculates a similarity between the synthesized sound output from the speaker and the sound acquired by the first microphone when the synthesized sound is output from the speaker and a similarity between the synthesized sound output from the speaker and the sound acquired by the second microphone when the synthesized sound is output from the speaker. If both of the similarities exceed a similarity threshold, the updating unit updates the reference threshold such that the reference threshold increases as the sound pressure difference between sound pressures of a certain frequency component of sound acquired by the first microphone and the second microphone when the synthesized sound is output from the speaker increases.

In the second embodiment, the reference threshold may be appropriately updated by reducing the influence of the noise. Thus, the accuracy of determining the direction of the sound source by using omnidirectional microphones may be further increased, regardless of the size of a gap between the housing of the information processing terminal and the wearer of the information processing terminal.

Third Embodiment

An example of a third embodiment will be described next. The description of the configuration and operation that are substantially the same as those of the first and second embodiments will be omitted.

Figure 21:
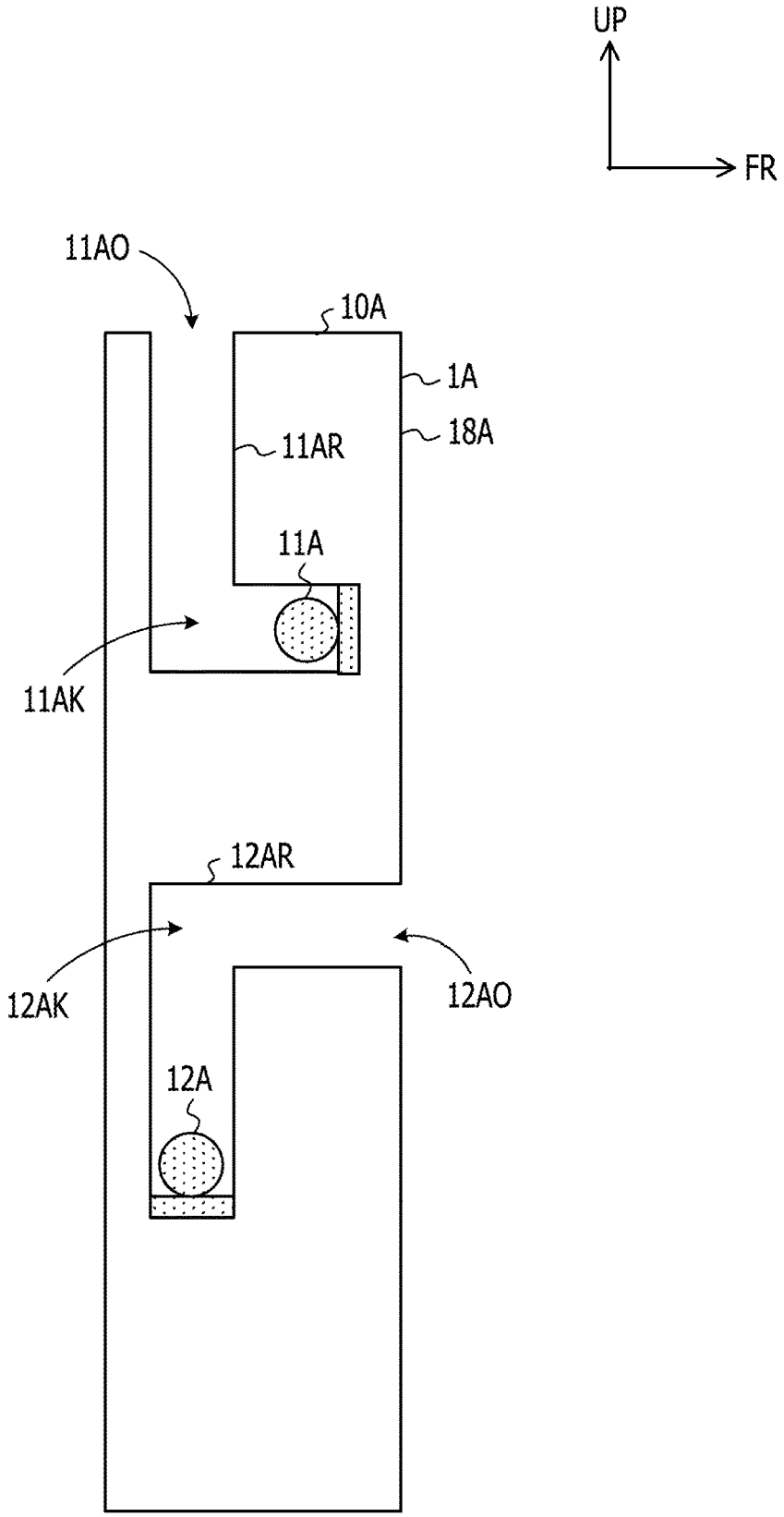
FIG. 21 is a sectional view taken along the line XXI-XXI in FIG. 2A in accordance with the third embodiment.

FIG. 21 is a sectional view taken along the line XXI-XXI in FIG. 2A. In the third embodiment, as in the first embodiment, the area of an upper surface of a housing 18A of an information processing terminal 1A is less than or equal to a certain value and the area of a front surface of the housing 18A of the information processing terminal 1A is greater than the certain value.

In the third embodiment, a first sound path 11AR has a diffraction portion, which is an example of a first diffraction portion that diffracts sound, at an opening 11AO. The first sound path 11AR also has a diffraction portion, which is a bend 11AK that diffracts sound and is an example of a second diffraction portion, midway thereof. A second sound path 12AR has a diffraction portion, which is an example of a third diffraction portion that diffracts sound, at a second opening 12AO. The second sound path 12AR also has a diffraction portion, which is a bend 12AK that diffracts sound and is an example of a fourth diffraction portion, midway thereof.

The front surface of the housing 18A of the information processing terminal 1A has an area greater than the certain value as in the first and second embodiments. The second sound path 12AR has midway thereof the bend 12AK that is a diffraction portion, unlike the first and second embodiments.

In the third embodiment, with the above-described configuration, the accuracy of determining the direction of the sound source by using omnidirectional microphones may be increased based on a sound reduction in a certain frequency component (for example, a high-frequency component) due to diffraction. Thus, the accuracy of determining the direction of the sound source by using omnidirectional microphones may be further increased, regardless of the size of a gap between the housing of the information processing terminal and the wearer of the information processing terminal.

In the first to third embodiments, the example has been described in which a sound signal, for which the direction of the sound source is determined, is translated by the speech translating apparatus 16 from the first language into the second language or from the second language into the first language depending on the direction of the sound source. However, the first to third embodiments are not limited to this example. The speech translating apparatus 16 may include, for example, only one of the first translating unit 16A and the second translating unit 16B.

Also, the information processing terminal 1 may include a conference support apparatus or the like instead of the speech translating apparatus 16. The processing order illustrated in the flowcharts of FIGS. 16 and 20 is merely an example, and the first to third embodiments are not limited to this processing order.

[Related Art]

Figure 22:
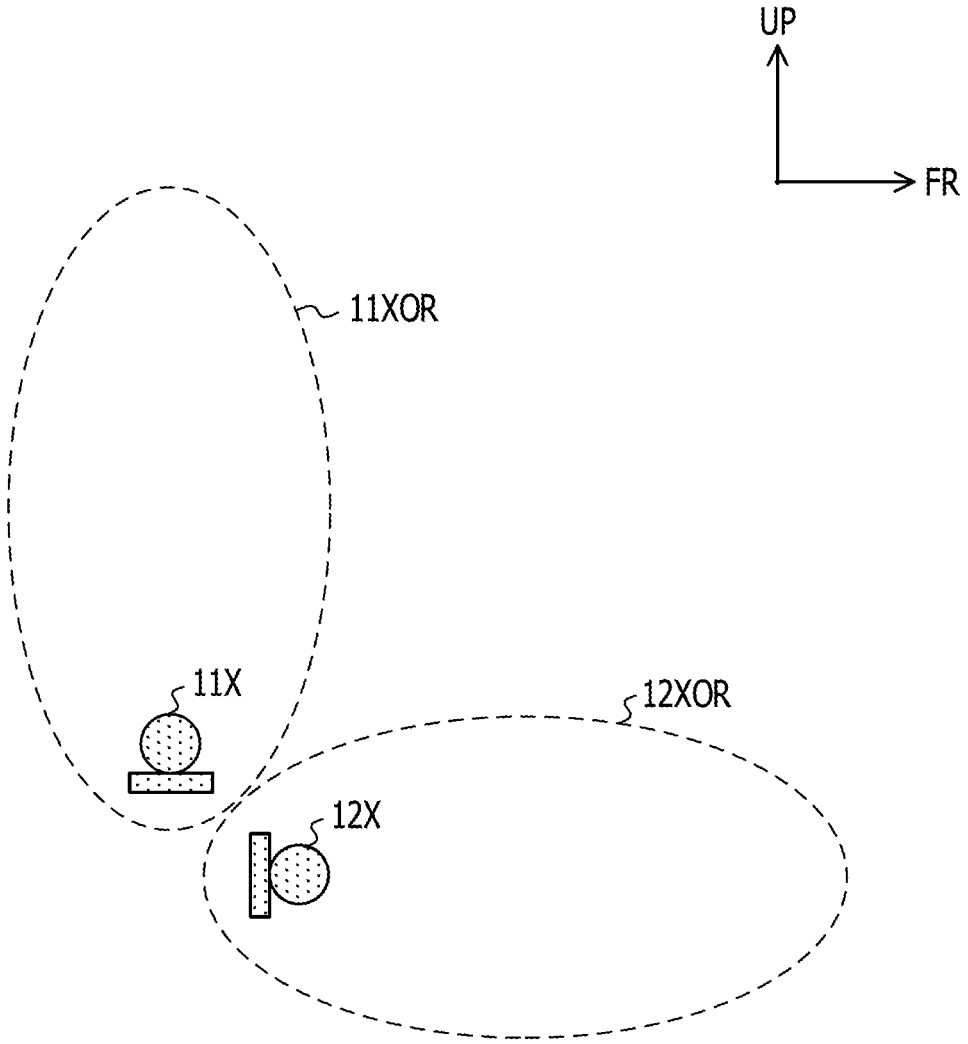
FIG. 22 is a schematic diagram illustrating an example of a sound-source-direction determining apparatus using directional microphones according to the related art.

The related art will be described next. In the related art, two directional microphones are arranged such that directivity 11XOR of a directional microphone 11X and directivity 12XOR of a directional microphone 12X intersect with each other as illustrated in FIG. 22. For example, the directivity 11XOR is directed upward and the directivity 12XOR is directed forward.

With this configuration, the direction of the sound source may be determined by using a sound pressure difference between sound pressure of sound acquired by the directional microphone 11X and sound pressure of the sound acquired by the directional microphone 12X. Specifically, if the sound pressure of the sound acquired by the directional microphone 11X is greater than the sound pressure of the sound acquired by the directional microphone 12X, the sound source is located above. If the sound pressure of the sound acquired by the directional microphone 12X is greater than the sound pressure of the sound acquired by the directional microphone 11X, the sound source is located in front.

However, directional microphones are larger than omnidirectional microphones as illustrated in FIG. 23. Thus, it is difficult to reduce the size of the sound-source-direction determining apparatus when the directional microphones are used. In the example of FIG. 23, the volume of the directional microphone is 226 [cubic mm], whereas the volume of the omnidirectional microphone is 11 [cubic mm]. That is, the volume of the directional microphone is approximately 20 times the volume of the omnidirectional microphone. Further, directional microphones are more costly than omnidirectional microphones. Thus, it is difficult to reduce the price of the sound-source-direction determining apparatus.

Figure 24A:
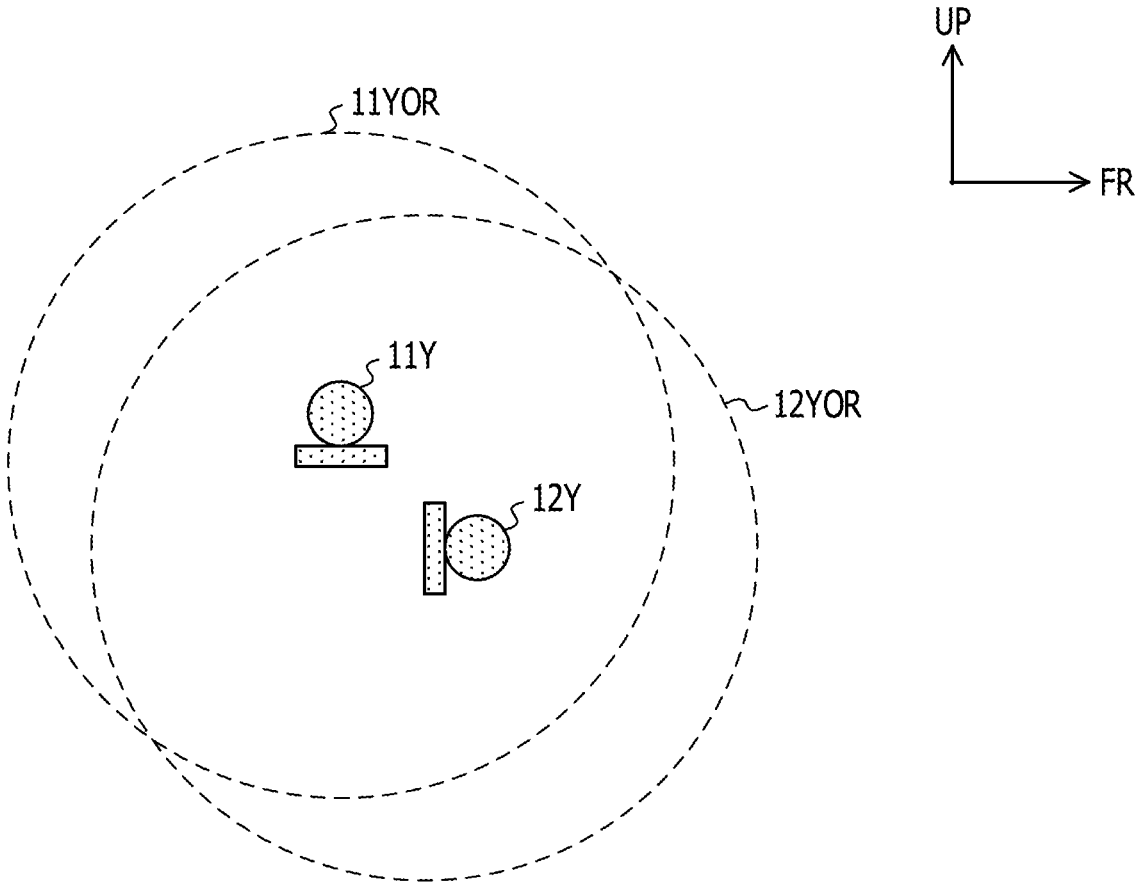
FIG. 24A is a schematic diagram illustrating an example of a sound-source-direction determining apparatus using omnidirectional microphones according to the related art.

It is difficult to implement a sound-source-direction determining apparatus capable of accurately determining the direction of the sound source, by simply replacing the directional microphones of the sound-source-direction determining apparatus illustrated in FIG. 22 with omnidirectional microphones. As illustrated in FIG. 24A, a range 11YOR where an omnidirectional microphone 11Y is able to acquire sound and a range 12YOR where an omnidirectional microphone 12Y is able to acquire sound substantially overlap with each other. Thus, the sound pressures of sound acquired by the omnidirectional microphones 11Y and 12Y do not significantly differ to an extent with which the direction of the sound source is accurately determined.

Figure 24B:
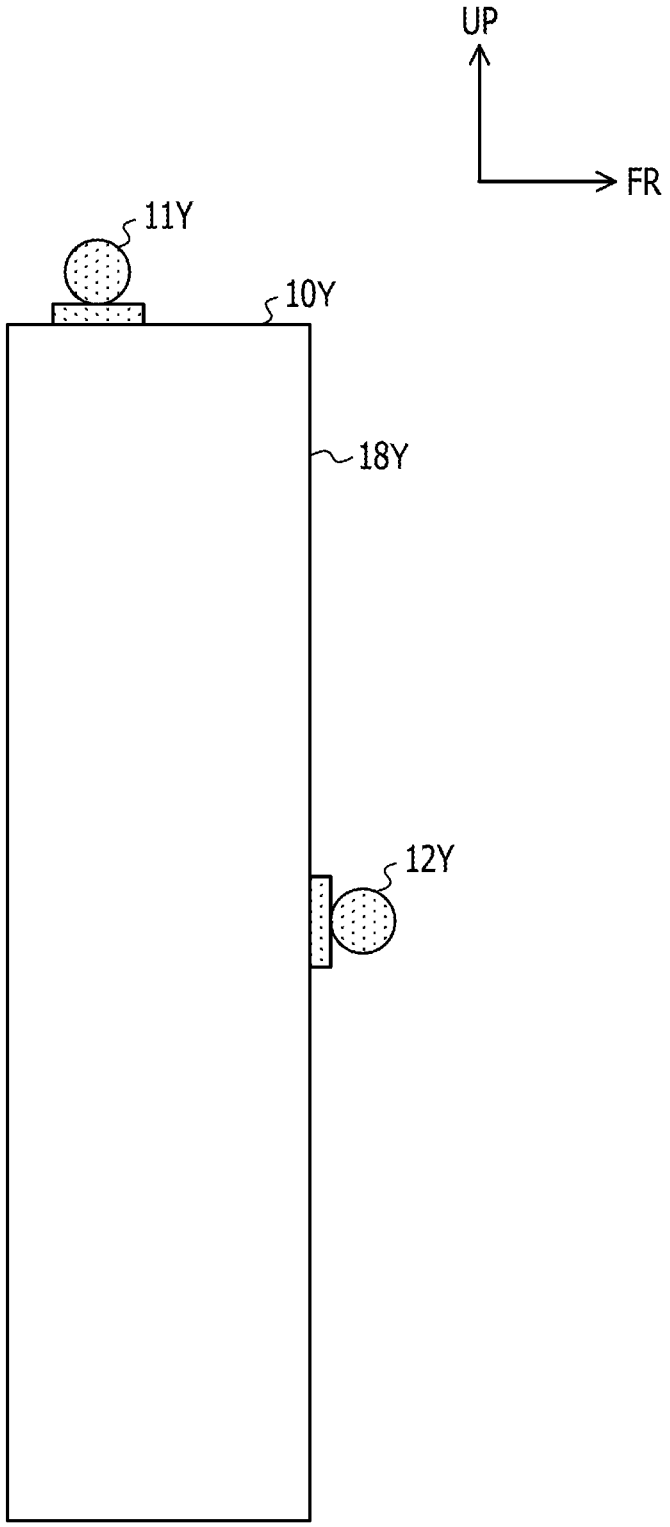
FIG. 24B is a schematic diagram illustrating an example of a sound-source-direction determining apparatus using omnidirectional microphones according to the related art.

FIG. 24B illustrates an information processing terminal 1Y according to the related art. The information processing terminal 1Y has a width of approximately 1 [cm] in the front-rear direction and a size of the front surface is approximately as large as the business card as in the first to third embodiments. In the information processing terminal 1Y, a first microphone 11Y is disposed on the upper surface of a housing 18Y and a second microphone 12Y is disposed on the front surface of the housing 18Y. The first microphone 11Y and the second microphone 12Y are omnidirectional microphones. FIG. 25 illustrates the sound pressure difference obtained by a sound-source-direction determining apparatus 10Y of the information processing terminal 1Y according to the related art and the sound pressure difference obtained by the sound-source-direction determining apparatus 10 according to the first embodiment. When the sound source is located above the information processing terminals 1 and 1Y, the sound pressure difference between the sound pressure of the sound acquired by the first microphone and the sound pressure of the sound acquired by the second microphone is equal to 2.9 [dB] in the related art and is equal to 7.2 [dB] in the first embodiment.

When the sound source is located in front of the information processing terminals 1 and 1Y, the sound pressure difference between the sound pressure of the sound acquired by the first microphone and the sound pressure of the sound acquired by the second microphone is equal to −2.9 [dB] in the related art and is equal to −4.2 [dB] in the first embodiment. That is, when the sound source is located above the information processing terminals 1 and 1Y, the sound pressure difference calculated in the first embodiment is greater than that of the related art by 4.3 [dB]. When the sound source is located in front of the information processing terminals 1 and 1Y, the sound pressure difference calculated in the first embodiment is smaller than that of the related art by 1.3 [dB].

Therefore, in the first embodiment, the possibility of obtaining an erroneous determination result as a result of the determination performed in step 111 of FIG. 16 may be reduced. Thus, according to the first to third embodiments, the accuracy of determining the direction of the sound source by using omnidirectional microphones may be further increased, regardless of the size of a gap between the housing of the information processing terminal and a wearer of the information processing terminal.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that the various changes, substitutions, and alterations could be made hereto without departing from the spirit and scope of the invention.

What is claimed is:

1. A sound-source-direction determining apparatus, comprising:

a microphone disposed portion having therein a first sound path having a first end and a second end and a second sound path having a first end and a second end, the first sound path having, at the first end thereof, a first opening that is open at a first flat surface, sound propagating through the first sound path from the first opening, the second sound path having, at the first end thereof, a second opening that is open at a second flat surface intersecting with the first flat surface, sound propagating through the second sound path from the second opening;

a first microphone that is omnidirectional and is disposed at or in the vicinity of the second end of the first sound path;

a second microphone that is omnidirectional and is disposed at or in the vicinity of the second end of the second sound path;

a speaker that outputs synthesized sound; and a processor, wherein the processor updates a reference threshold such that the reference threshold increases as a sound pressure difference increases, the sound pressure difference being a difference between sound pressure of a certain frequency component of sound acquired by the first microphone and sound pressure of the certain frequency component of the sound acquired by the second microphone when the synthesized sound is output from the speaker, and determines a direction in which a sound source of sound is located, based on comparison between the reference threshold and a sound pressure difference between sound pressure of a certain frequency component of the sound acquired by the first microphone and sound pressure of the certain frequency component of the sound acquired by the second microphone when the synthesized sound is not output from the speaker.

2. The sound-source-direction determining apparatus according to claim 1, wherein the processor updates, in a case where a similarity between the synthesized sound output from the speaker and the sound acquired by the first microphone when the synthesized sound is output from the speaker and a similarity between the synthesized sound output from the speaker and the sound acquired by the second microphone when the synthesized sound is output from the speaker exceed a similarity threshold, the reference threshold such that the reference threshold increases as the sound pressure difference increases, the sound pressure difference being the difference between the sound pressure of the certain frequency component of the sound acquired by the first microphone and the sound pressure of the certain frequency component of the sound acquired by the second microphone when the synthesized sound is output from the speaker.

3. The sound-source-direction determining apparatus according to claim 1, wherein the certain frequency component is a high-frequency component.

4. The sound-source-direction determining apparatus according to claim 1, wherein the first flat surface and the second flat surface intersect at a right angle, the first flat surface has an area that is less than or equal to a certain value and the second flat surface has an area that is greater than the certain value, the first sound path has, at the first opening, a first diffraction portion that diffracts sound and has, midway thereof, a second diffraction portion that is a bend that diffracts the sound, and the second sound path has, at the second opening, a third diffraction portion that diffracts sound.

5. The sound-source-direction determining apparatus according to claim 1, wherein the first flat surface and the second flat surface intersect at a right angle, the first flat surface has an area that is less than or equal to a certain value and the second flat surface has an area that is greater than the certain value, the first sound path has, at the first opening, a first diffraction portion that diffracts sound and has, midway thereof, a second diffraction portion that is a bend that diffracts the sound, and the second sound path has, at the second opening, a third diffraction portion that diffracts sound and has, midway thereof, a fourth diffraction portion that is a bend that diffracts the sound.

6. The sound-source-direction determining apparatus according to claim 1, wherein the sound pressure difference is an average of values obtained by subtracting a logarithm of power of the sound pressure obtained by the second microphone from a logarithm of power of the sound pressure obtained by the first microphone, in a case where the average is greater than the reference threshold, the processor determines that the sound source is located at a position facing the first flat surface, and in a case where the average is equal to or less than the reference threshold, the processor determines that the sound source is located at a position facing the second flat surface.

7. The sound-source-direction determining apparatus according to claim 1, wherein in a case of determining that the sound source is located at a position facing the first flat surface, the processor translates a signal corresponding to the sound into a first language, and in a case of determining that the sound source is located at a position facing the second flat surface, the processor translates a signal corresponding to the sound into a second language.

8. A sound-source-direction determining method carried out by a computer of a sound-source-direction determining apparatus, the sound-source-direction determining apparatus including a microphone disposed portion, a first microphone, a second microphone, a speaker, and the computer, the microphone disposed portion having therein a first sound path having a first end and a second end and a second sound path having a first end and a second end, the first sound path having, at the first end thereof, a first opening that is open at a first flat surface, sound propagating through the first sound path from the first opening, the second sound path having, at the first end thereof, a second opening that is open at a second flat surface intersecting with the first flat surface, sound propagating through the second sound path from the second opening, the first microphone being omnidirectional and being disposed at or in the vicinity of the second end of the first sound path, the second microphone being omnidirectional and being disposed at or in the vicinity of the second end of the second sound path, the speaker being configured to output synthesized sound, the sound-source-direction determining method comprising:

updating a reference threshold such that the reference threshold increases as a sound pressure difference increases, the sound pressure difference being a difference between sound pressure of a certain frequency component of sound acquired by the first microphone and sound pressure of the certain frequency component of the sound acquired by the second microphone when the synthesized sound is output from the speaker; and determining a direction in which a sound source of sound is located, based on comparison between the reference threshold and a sound pressure difference between sound pressure of a certain frequency component of the sound acquired by the first microphone and sound pressure of the certain frequency component of the sound acquired by the second microphone when the synthesized sound is not output from the speaker.

9. The sound-source-direction determining method according to claim 8, wherein in the updating of the reference threshold, in a case where a similarity between the synthesized sound output from the speaker and the sound acquired by the first microphone when the synthesized sound is output from the speaker and a similarity between the synthesized sound output from the speaker and the sound acquired by the second microphone when the synthesized sound is output from the speaker exceed a similarity threshold, the reference threshold is updated such that the reference threshold increases as the sound pressure difference increases, the sound pressure difference being the difference between the sound pressure of the certain frequency component of the sound acquired by the first microphone and the sound pressure of the certain frequency component of the sound acquired by the second microphone when the synthesized sound is output from the speaker.

10. The sound-source-direction determining method according to claim 8, wherein the certain frequency component is a high-frequency component.

11. The sound-source-direction determining method according to claim 8, wherein the sound pressure difference is an average of values obtained by subtracting a logarithm of power of the sound pressure obtained by the second microphone from a logarithm of power of the sound pressure obtained by the first microphone, in the determining of the direction in which the sound source is located, it is determined that the sound source is located at a position facing the first flat surface in a case where the average is greater than the reference threshold and it is determined that the sound source is located at a position facing the second flat surface in a case where the average is equal to or less than the reference threshold.

12. The sound-source-direction determining method according to claim 8, further comprising:

translating a signal corresponding to the sound into a first language in a case where it is determined that the sound source is located at a position facing the first flat surface, and translating a signal corresponding to the sound into a second language in a case where it is determined that the sound source is located at a position facing the second flat surface.

13. A non-transitory computer-readable storage medium storing a program that causes a processor included in a sound-source-direction determining apparatus to execute a process, the sound-source-direction determining apparatus including a speaker, a first microphone, and a second microphone, the process comprising:

updating a reference threshold such that the reference threshold increases as a sound pressure difference increases, the sound pressure difference being a difference between sound pressure of a certain frequency component of sound acquired by the first microphone and sound pressure of the certain frequency component of the sound acquired by the second microphone when the synthesized sound is output from the speaker, and determining a direction in which a sound source of sound is located, based on comparison between the reference threshold and a sound pressure difference between sound pressure of a certain frequency component of the sound acquired by the first microphone and sound pressure of the certain frequency component of the sound acquired by the second microphone when the synthesized sound is not output from the speaker.

14. The non-transitory computer-readable storage medium according to claim 13, wherein in the updating of the reference threshold, in a case where a similarity between the synthesized sound output from the speaker and the sound acquired by the first microphone when the synthesized sound is output from the speaker and a similarity between the synthesized sound output from the speaker and the sound acquired by the second microphone when the synthesized sound is output from the speaker exceed a similarity threshold, the reference threshold is updated such that the reference threshold increases as the sound pressure difference increases, the sound pressure difference being the difference between the sound pressure of the certain frequency component of the sound acquired by the first microphone and the sound pressure of the certain frequency component of the sound acquired by the second microphone when the synthesized sound is output from the speaker.

15. The non-transitory computer-readable storage medium according to claim 13, wherein the certain frequency component is a high-frequency component.

16. The non-transitory computer-readable storage medium according to claim 13, wherein the sound pressure difference is an average of values obtained by subtracting a logarithm of power of the sound pressure obtained by the second microphone from a logarithm of power of the sound pressure obtained by the first microphone, it is determined that the sound source is located at a position facing the first flat surface in a case where the average is greater than the reference threshold, and it is determined that the sound source is located at a position facing the second flat surface in a case where the average is equal to or less than the reference threshold.

17. The non-transitory computer-readable storage medium according to claim 13, the process further comprising:

translating a signal corresponding to the sound into a first language in a case where it is determined that the sound source is located at a position facing the first flat surface, and translating a signal corresponding to the sound into a second language in a case where it is determined that the sound source is located at a position facing the second flat surface.

* * * * *